US011268675B2

(12) United States Patent
Tomimoto

(10) Patent No.: US 11,268,675 B2
(45) Date of Patent: Mar. 8, 2022

(54) INDICATING LAMP

(71) Applicant: PATLITE CORPORATION, Osaka (JP)

(72) Inventor: Masao Tomimoto, Osaka (JP)

(73) Assignee: PATLITE CORPORATION, Osaka (JP)

( * ) Notice: Subject to any disclaimer, the term of this patent is extended or adjusted under 35 U.S.C. 154(b) by 0 days.

(21) Appl. No.: 17/278,751

(22) PCT Filed: Aug. 29, 2019

(86) PCT No.: PCT/JP2019/034004
§ 371 (c)(1),
(2) Date: Mar. 23, 2021

(87) PCT Pub. No.: WO2021/038809
PCT Pub. Date: Mar. 4, 2021

(65) Prior Publication Data
US 2022/0034480 A1 Feb. 3, 2022

(51) Int. Cl.
*F21K 9/237* (2016.01)
*F21V 5/04* (2006.01)
(Continued)

(52) U.S. Cl.
CPC ..... *F21V 5/045* (2013.01); *F21K 9/237* (2016.08); *F21K 9/238* (2016.08); *F21K 9/69* (2016.08);
(Continued)

(58) Field of Classification Search
CPC . F21V 5/045; F21K 9/69; F21K 9/232; F21K 9/237; F21K 9/238
See application file for complete search history.

(56) References Cited

U.S. PATENT DOCUMENTS

2016/0102849 A1* 4/2016 Kwok ..... F21V 14/00 362/363
2016/0252217 A1* 9/2016 Achterhuis ..... F21V 23/06 362/183
2017/0276319 A1 9/2017 Shigematsu

FOREIGN PATENT DOCUMENTS

JP 2001167610 A 6/2001
JP 2007165057 A 6/2007
(Continued)

*Primary Examiner* — Karabi Guharay
(74) *Attorney, Agent, or Firm* — Rabin & Berdo, P.C.

(57) ABSTRACT

When viewed in parallel to a central axis (C1), three LED substrates (4) form an equilateral triangle (T) that surrounds the central axis (C1) and are disposed equidistantly with respect to the central axis (C1). When viewed in parallel to the central axis (C1), LEDs (8) are disposed on an outer surface (4*a*) of each LED substrate (4) at least one each at each of a pair of placement positions (Q1) at both sides sandwiching a reference normal (BN) being a normal to the outer surface (4*a*) and passing through the central axis (C1). The LEDs (8) each have an optical axis (8*a*) orthogonal to the outer surface (4*a*). When viewed in parallel to the central axis (C1), radiated lights from the LEDs (8) at the pair of placement positions (Q1) of each LED substrate (4) are, by an optical system (K), converted to and emitted as emitted parallel lights (RPL) that are respectively parallel to a pair of light emission reference lines (RB) passing through the central axis (C1) at both sides sandwiching the reference normal (BN) and respectively contain the corresponding light emission reference lines (RB).

20 Claims, 17 Drawing Sheets

(51) Int. Cl.

| | |
|---|---|
| ***F21K 9/69*** | (2016.01) |
| ***F21K 9/238*** | (2016.01) |
| *F21Y 115/10* | (2016.01) |
| *F21W 111/00* | (2006.01) |
| *F21Y 107/50* | (2016.01) |

(52) U.S. Cl.
CPC ..... *F21W 2111/00* (2013.01); *F21Y 2107/50* (2016.08); *F21Y 2115/10* (2016.08)

(56) References Cited

FOREIGN PATENT DOCUMENTS

| | | | |
|---|---|---|---|
| JP | 2012099243 | A | 5/2012 |
| JP | 2015103511 | A | 6/2015 |
| JP | 2015522935 | A | 8/2015 |
| WO | 2017022143 | A1 | 2/2017 |

* cited by examiner

INDICATING LAMP

TECHNICAL FIELD

The present invention relates to an indicating lamp used in mechanical equipment and signboard lamps.

BACKGROUND ART

In a simulated rotating lamp disclosed in Patent Literature 1, a large number of (for example, ten-some) light emitting groups provided at predetermined intervals along an outer circumferential surface of a supporting body (for example, a flexible substrate) of circular cylindrical shape each includes a plurality of (for example, ten) light emitters disposed in parallel to an axial direction of the supporting body. The light emitting groups that are adjacent in a circumferential direction of the supporting body are partitioned therebetween by partitioning plates of plate shape that extend in parallel to the axial direction of the supporting body.

With the simulated rotating lamp, the light emitters are lit and unlit according to each light emitting group to make an observer have an illusion that a reflecting mirror is reflecting the light of the light emitters while rotating around a periphery of the light emitters.

CITATION LIST

Patent Literature

Patent Literature 1: Japanese Patent Application Publication No. 2007-165057

SUMMARY OF INVENTION

Technical Problem

However, since a large number of LEDs are used, manufacturing cost increases due to increases in parts cost and assembly cost. If, for instance, the number of LEDs is reduced for cost reduction, visibility decreases. This type of problem exists not just with simulated rotating lamps but for indicating lamps in general as well.

An object of the present invention is to provide an indicating lamp that is high in visibility, low in the number of parts, and inexpensive.

Solution to Problem

The present invention provides an indicating lamp that emits light radially toward a periphery of a central axis and away from the central axis and is an indicating lamp that includes three LED substrates that, when viewed in parallel to the central axis, form an equilateral triangle surrounding the central axis and are disposed equidistantly with respect to the central axis, LEDs that, when viewed in parallel to the central axis, are disposed on an outer surface of each LED substrate at least one each at each of a pair of placement positions at both sides sandwiching a reference normal being a normal to the outer surface of each LED substrate and passing through the central axis and each have an optical axis orthogonal to the outer surface of each LED substrate, and an optical system by which, when viewed in parallel to the central axis, radiated lights from the LEDs at the pair of placement positions of each LED substrate are converted to and emitted as emitted parallel lights that are respectively parallel to a pair of light emission reference lines passing through the central axis at both sides sandwiching the reference normal of each LED substrate and respectively contain the corresponding light emission reference lines.

In this arrangement, the radiated lights of the LEDs disposed at the pair of placement positions in each of the three LED substrates that form the equilateral triangle are converted to and radially emitted as the emitted parallel lights that are respectively parallel to the pair of light emission reference lines passing through the central axis at both sides of the reference normal to each LED substrate and respectively contain the corresponding light emission reference lines. An appearance of light being emitted from a position of the central axis of the indicating lamp can thus be visualized. Consequently, visibility can be improved inexpensively using a small number of the LED substrates and a small number of the LEDs.

In the indicating lamp of the present invention, the optical system may include six columnar lenses disposed annularly around the central axis and extending in parallel to the central axis and the six columnar lenses may respectively take in the radiated lights from the LEDs at the pairs of placement positions of the three LED substrates and output exiting parallel lights that, when viewed in parallel to the central axis, are respectively parallel to the corresponding light emission reference lines or inclined with respect to the corresponding light emission reference lines.

In this arrangement, parallel light that is parallel to the corresponding light emission reference line or is inclined with respect to the corresponding light emission reference line is obtained by each columnar lens. Optical design for emitting parallel lights parallel to the light emission reference lines that pass through the central axis is thereby made easy.

In the indicating lamp of the present invention, the six columnar lenses may be disposed with gaps provided between each other. With this arrangement, it is made possible to use back surfaces of facing surfaces between the columnar lenses as optical elements.

In the indicating lamp of the present invention, when viewed in parallel to the central axis, a circumscribing circle passing through vertices of the equilateral triangle may intersect the six columnar lenses. With this arrangement, compact size can be realized.

In the indicating lamp of the present invention, a translucent globe of cylindrical shape that surrounds the three LED substrates and the six columnar lenses and is centered on the central axis may be included and the globe and the columnar lenses may be formed integrally. With this arrangement, the number of parts can be reduced and manufacturing cost can be made inexpensive.

In the indicating lamp of the present invention, a translucent globe of cylindrical shape that surrounds the three LED substrates and the six columnar lenses and is centered on the central axis may be included and the optical system may include a diffusing lens that is provided on the globe and diffuses the exiting lights from the columnar lenses in a circumferential direction of the globe and a light collecting lens that is provided on the globe and suppresses the exiting lights from the columnar lenses from spreading in directions parallel to the central axis. With this arrangement, light can be emitted effectively in a required range.

In the indicating lamp of the present invention, the globe may include an inner globe that has an inner circumferential surface on which the diffusing lens is formed and an outer circumferential surface on which a Fresnel lens is formed as the light collecting lens and an outer globe that surrounds the inner globe. With this arrangement, design quality can be improved.

In the indicating lamp of the present invention, the globe may include an inner globe that has an outer circumferential surface on which a Fresnel lens is formed as the light collecting lens and an outer globe surrounding the inner globe and having an inner circumferential surface on which the diffusing lens is formed. With this arrangement, manufacture is made easy in a case where the globe is to be resin molded.

In the indicating lamp of the present invention, when viewed in parallel to the central axis, the pair of placement positions on the outer surface of each LED substrate may be symmetrical with respect to the reference normal of each LED substrate. With this arrangement, the LED substrates can be commonized favorably.

In the indicating lamp of the present invention, when viewed in parallel to the central axis, the pair of light emission reference lines with respect to each LED substrate may be symmetrical with respect to the reference normal of each LED substrate. With this arrangement, parallel lights that are uniform can be obtained.

In the indicating lamp of the present invention, when viewed in parallel to the central axis, the pair of light emission reference lines with respect to each LED substrate may be inclined in mutually opposite directions at an inclination angle of 60° with respect to the outer surface of each LED substrate. With this arrangement, the parallel lights that are uniform can be obtained.

In the indicating lamp of the present invention, when viewed in parallel to the central axis, the pair of placement positions on each LED substrate may be disposed at outer sides of the pair of light emission reference lines with respect to each LED substrate. With this arrangement, distance can be secured between the LEDs at the pair of placement positions. Attachment of the LEDs onto the LED substrate during manufacture is thus made easy.

In the indicating lamp of the present invention, a plurality of LEDs may be aligned in a single column in a direction parallel to the central axis at each of the pair of placement positions of each LED substrate. With this arrangement, an indicating range can be made wide.

In the indicating lamp of the present invention, when viewed in parallel to the central axis, an effective radiation region of each LED may include a central region through which the optical axis of the LED passes, a reference normal side region that is the reference normal side with respect to the central region, and an opposite side region at an opposite side to the reference normal side region, each columnar lens may include a first lens portion that takes in light radiated from the corresponding LED to the reference normal side region and outputs a first exiting parallel light, a second lens portion that takes in light radiated from the corresponding LED to the central region and outputs a second exiting parallel light, and a third lens portion that takes in light radiated from the corresponding LED to the opposite side region and outputs a third exiting parallel light, and the first exiting parallel light, the second exiting parallel light, and the third exiting parallel light may be directed in the same direction.

With this arrangement, the light from the effective radiation region of the LED can be converted to the parallel lights directed in the same direction by the lens portions that are in accordance with radiation directions.

In the indicating lamp of the present invention, the first lens portion may include a first incidence surface that takes in without refraction the light radiated to the reference normal side region, an internal reflection surface that is a paraboloid that totally reflects light transmitted through the first incidence surface to make it a first internal parallel light, and a first exit surface that outputs without refraction the first internal parallel light from the internal reflection surface as the first exiting parallel light. With this arrangement, the light radiated to the reference normal side region from the LED can be collected and guided by total reflection by the internal reflection surface to the side opposite the reference normal side.

In the indicating lamp of the present invention, the second lens portion may include a second incidence surface that refracts and takes in the light radiated to the central region to make it a second internal parallel light and a second exit surface that refracts and outputs the second internal parallel light from the second incidence surface to make it the second exiting parallel light. With this arrangement, the light radiated to the central region from the LED can be collected and changed in direction.

In the indicating lamp of the present invention, the third lens portion may include a third incidence surface that refracts and takes in the light radiated to the opposite side region to make it a third internal parallel light and a third exit surface that outputs without refraction the third internal parallel light from the third incidence surface as the third exiting parallel light. With this arrangement, the light radiated to the opposite side region from the LED can be collected and changed in direction.

In the indicating lamp of the present invention, the third incidence surface may be a Fresnel surface. With this arrangement, compact size can be realized.

In the indicating lamp of the present invention, a translucent globe of cylindrical shape that surrounds the three LED substrates and the six columnar lenses and is centered on the central axis and a base member coupled to an opening end of the globe may be included and the base member may include an LED substrate supporting portion that supports end portions of the LED substrates. With this arrangement, the three LED substrates can be supported in a state of an equilateral triangular configuration.

In the indicating lamp of the present invention, a power supply substrate supported by the base member may be included and three first connectors respectively disposed at the end portions of the three LED substrates and three second connectors disposed at the power supply substrate may be coupled as substrate-to-substrate connectors. With this arrangement, power can be supplied to the LED substrates without using an electric wire from the power supply substrate.

DESCRIPTION OF EMBODIMENTS

Preferred Embodiments of the Present Invention shall now be described specifically with reference to the drawings.

First Preferred Embodiment

Figure 1:
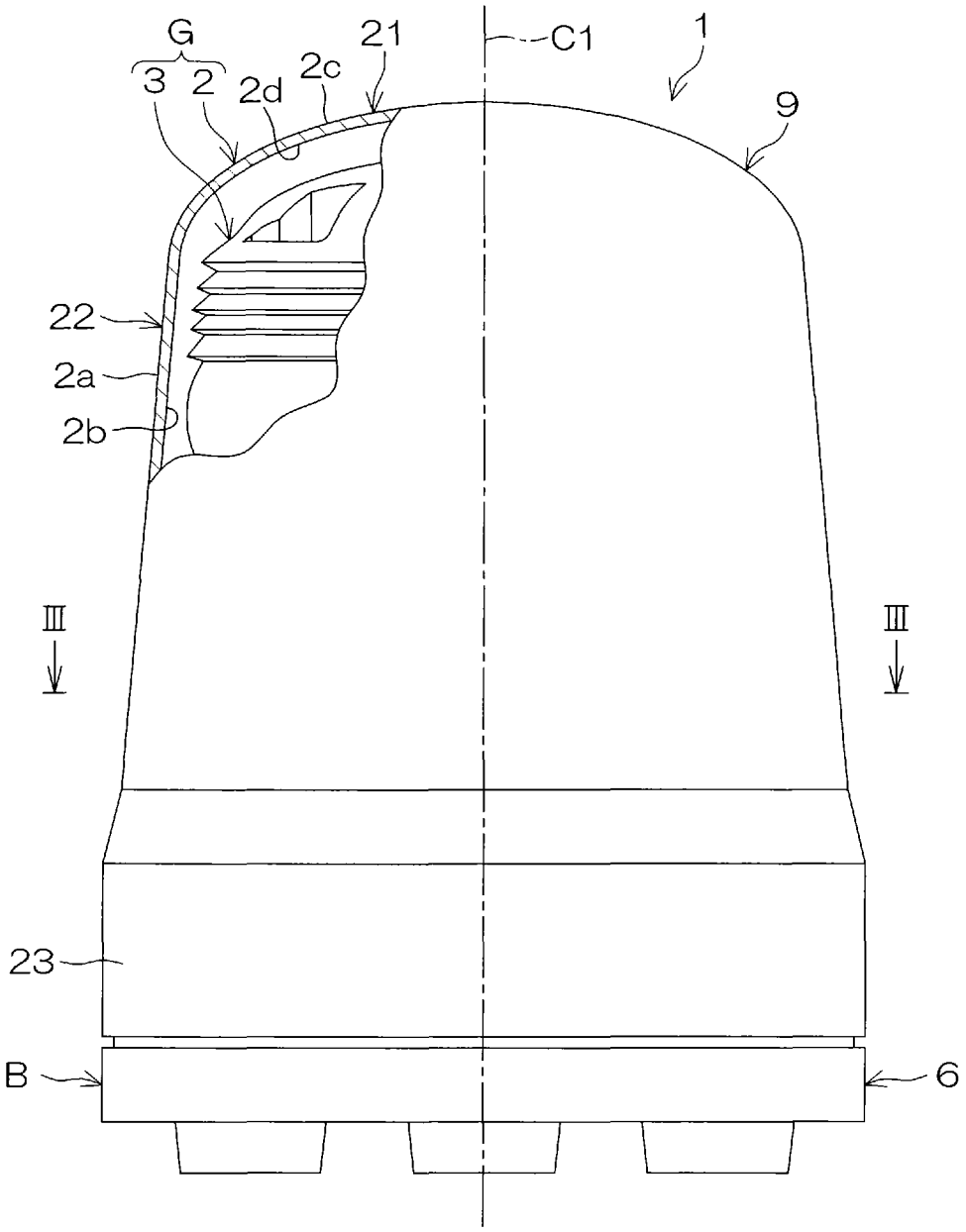
FIG. 1 is a partially broken away front view of an indicating lamp according to a first preferred embodiment of the present invention.
Figure 2:
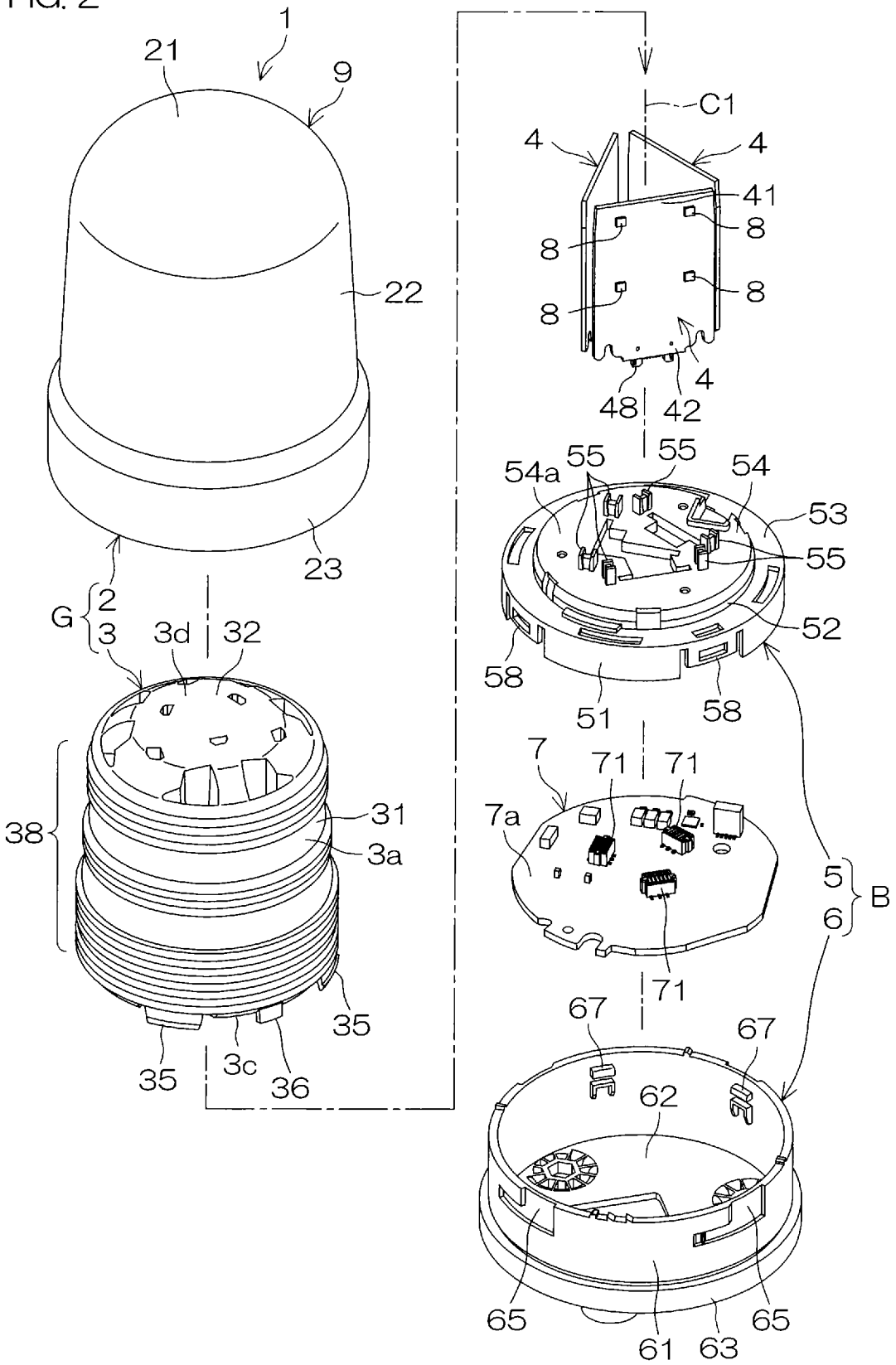
FIG. 2 is an exploded perspective view of the indicating lamp.
Figure 3:
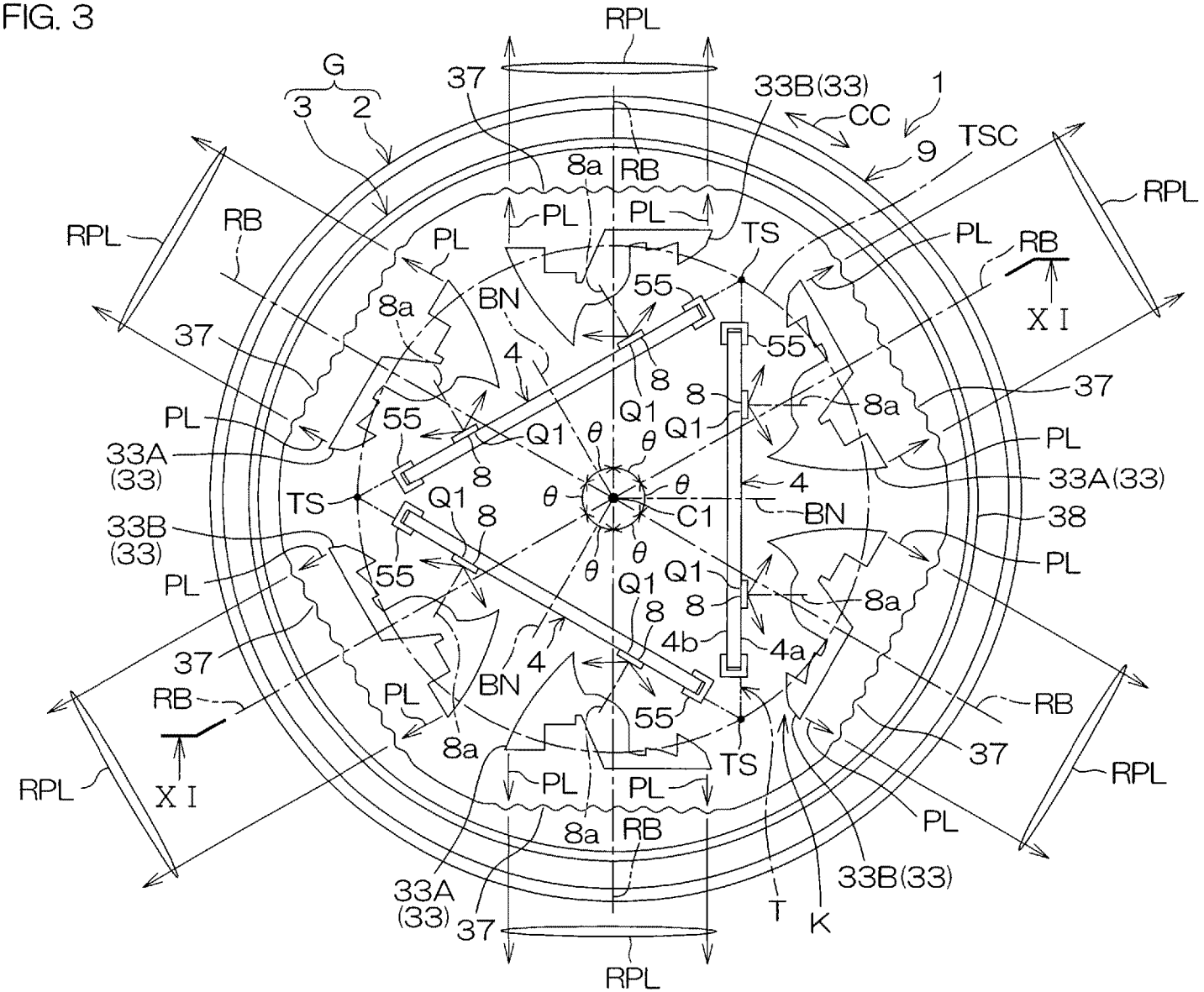
FIG. 3 is a general sectional view of the indicating lamp and corresponds to a sectional view taken on III-III of FIG. 1.

FIG. 1 is a partially broken away front view of an indicating lamp 1 according to a first preferred embodiment of the present invention. FIG. 2 is an exploded perspective view of the indicating lamp 1. FIG. 3 is a general sectional view of the indicating lamp 1 and corresponds to a sectional view taken on III-III of FIG. 1.

As shown in FIG. 1, the indicating lamp 1 is formed to a substantially circular cylindrical shape and has a central axis C1 extending in an up/down direction.

As shown in FIG. 1 and FIG. 2, the indicating lamp 1 includes a globe G constituted of an outer globe 2 and an inner globe 3, three LED substrates 4, a base member B constituted of a holder 5 and a lower case 6, and a power supply substrate 7. The globe G and the base member B are combined to form a hollow housing 9 (see FIG. 1). Although not shown, a space inside the housing 9 is partitioned above and below by the holder 5. Although not shown, inside the housing 9, the LED substrates are housed in a space above the holder 5 and the power supply substrate 7 is housed in a space below the holder 5.

As shown in FIG. 3, LEDs 8 are supported by each of the three LED substrates 4 housed inside the housing 9. Radiated lights from the LEDs 8 of the three LED substrates 4 are emitted radially toward a periphery of the central axis C1 in directions away from the central axis C1.

Specifically, as shown in FIG. 3, when viewed in parallel to the central axis C1, six light emission reference lines RB that pass through the central axis C1 are set. The six light emission reference lines RB are disposed at equiangular intervals in a peripheral direction CC that is a direction of the periphery of the central axis C1. That is, a central angle θ formed mutually by light emission reference lines RB that are adjacent in the peripheral direction CC is set to 60° (θ=60°). The indicating lamp 1 emits, to an exterior, emitted parallel lights RPL that are respectively parallel to the six light emission reference lines RB by an optical system K that includes three pairs of columnar lenses 33A and 33B, six diffusing lenses 37, and a light collecting lens 38.

The LED substrates 4 shall now be described.

Figure 4:
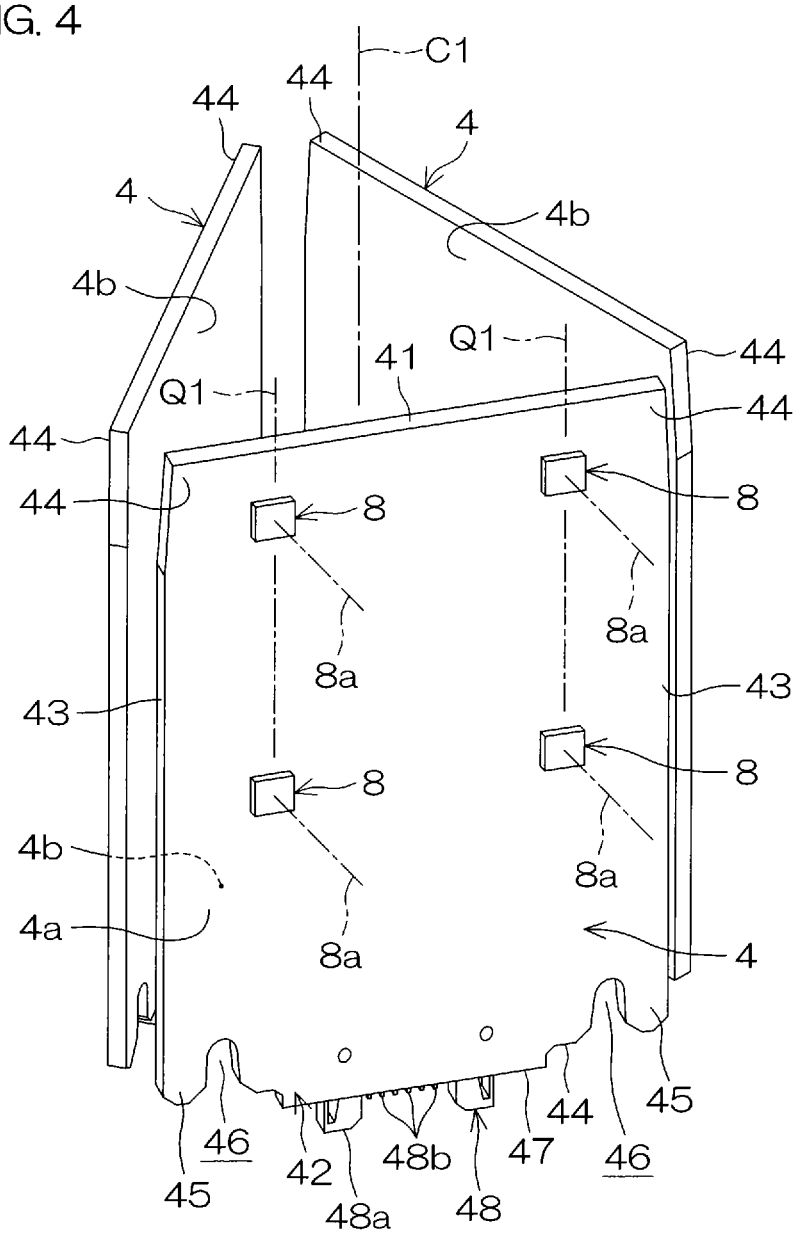
FIG. 4 is a perspective view of a configuration state of three LED substrates.
Figure 5:
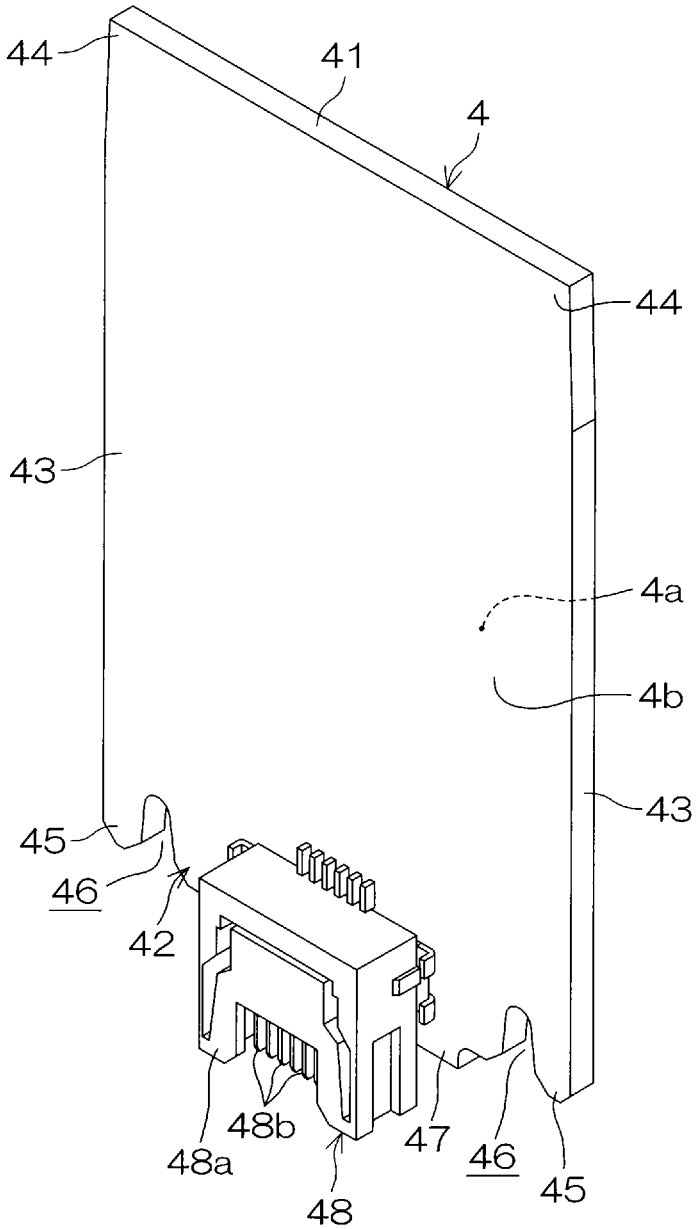
FIG. 5 is a perspective view of an LED substrate from a rear side.
Figure 6:
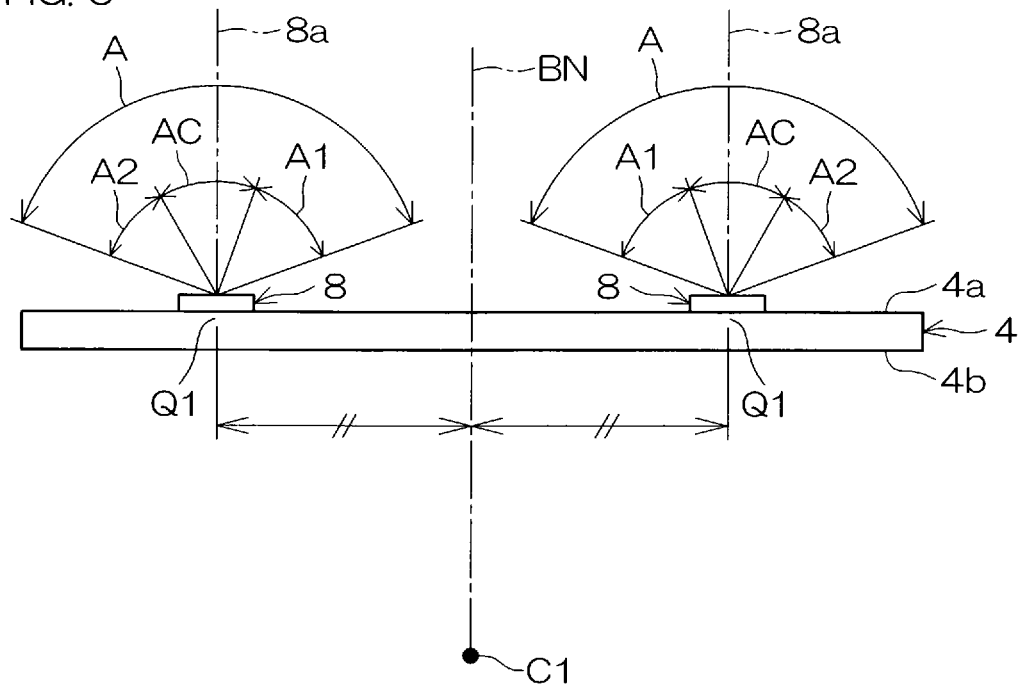
FIG. 6 is a transverse sectional view of the LED substrate showing radiation characteristics of LEDs.
Figure 7:
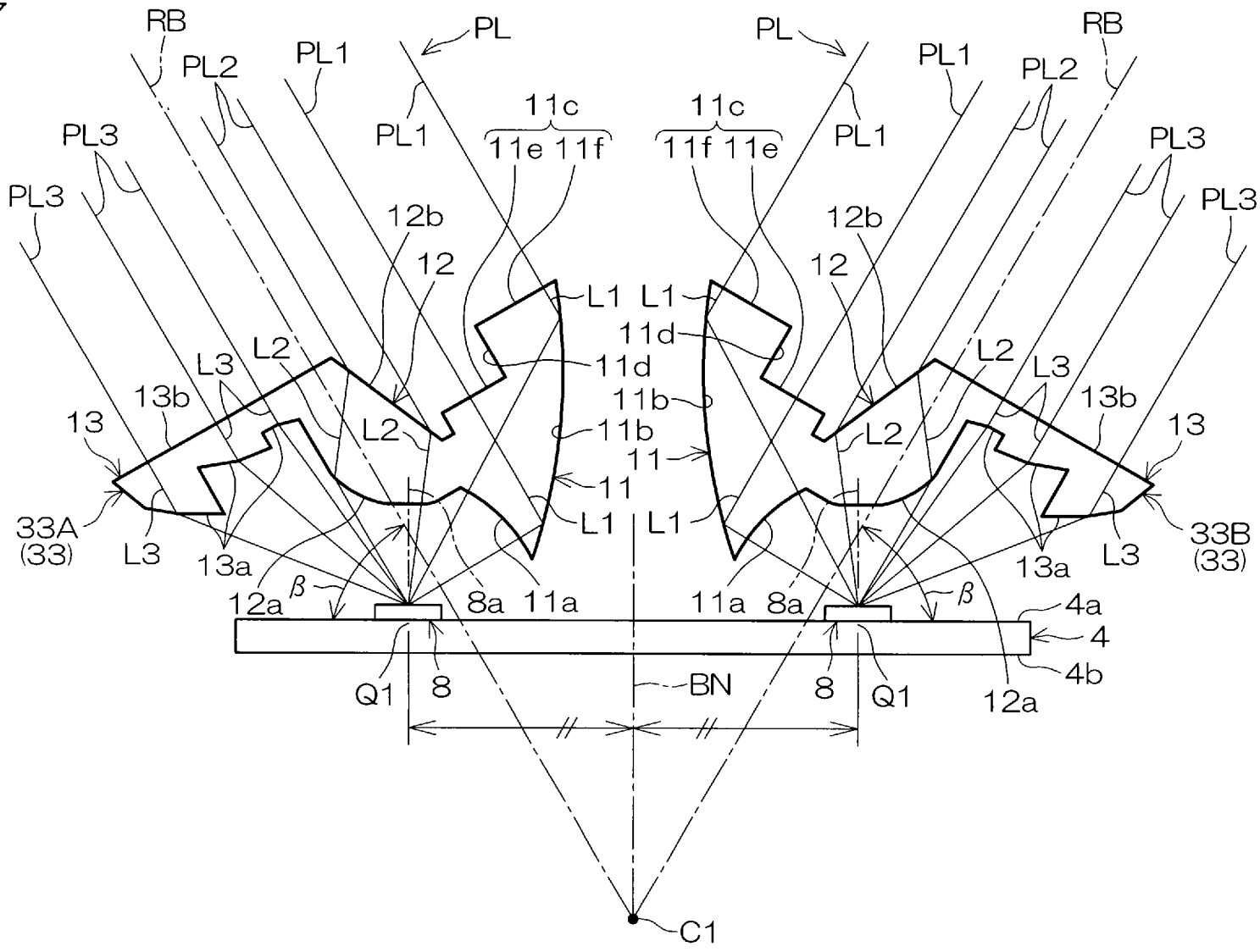
FIG. 7 is a transverse sectional view of the LED substrate and two corresponding columnar lenses showing light orientation characteristics.

FIG. 4 is a perspective view of a configuration state of the three LED substrates 4. FIG. 5 is a perspective view of an LED substrate 4 from a rear side. FIG. 6 is a transverse sectional view of the LED substrate 4 showing radiation characteristics of the LEDs 8. FIG. 7 is a transverse sectional view of the LED substrate 4 and a corresponding pair of columnar lenses 33A and 33B showing light orientation characteristics.

As shown in FIG. 3, when viewed in parallel to the central axis C1, the three LED substrates 4 form an equilateral triangle T that surrounds the central axis C1. The three LED substrates 4 are disposed equidistantly from the central axis C1. Each LED substrate 4 includes an outer surface 4*a* and an inner surface 4*b*.

As shown in FIG. 3 and FIG. 6, when viewed in parallel to the central axis C1, a normal to the outer surface 4*a* of an LED substrate 4 that is a normal that passes through the central axis C1 is a reference normal BN. When viewed in parallel to the central axis C1, LEDs 8 are disposed on the outer surface 4*a* of the LED substrate 4 at least one each at each of a pair of placement positions Q1 at both sides sandwiching the reference normal BN. When viewed in parallel to the central axis C1, the pair of placement positions Q1 on the outer surface 4*a* of the LED substrate 4 are symmetrical with respect to the reference normal BN.

In the present preferred embodiment, at each of the pair of placement positions Q1, two LEDs 8 are aligned in a single column in parallel to the central axis C1 as shown in FIG. 4. Each LED 8 has an optical axis 8*a* orthogonal to the outer surface 4*a* of the LED substrate 4.

As shown in FIG. 6, an effective radiation region A of each LED 8 includes a central region AC that includes the optical axis 8*a* of the LED 8 and a reference normal side region A1 and an opposite side region A2 disposed at respective sides of the central region AC. The reference normal side region A1 is disposed at the reference normal BN side with respect to the central region AC. The opposite side region A2 is disposed at an opposite side to the reference normal side region A1 with respect to the central region AC.

As shown in FIG. 7, a pair of the columnar lenses 33A and 33B of the optical system K are disposed respectively in correspondence to the LEDs 8 disposed at the pair of placement positions Q1.

As shown in FIG. 4 and FIG. 5, each LED substrate 4 is formed to a substantially rectangular shape. The LED substrate 4 has an upper end portion 41, a lower end portion 42, and a pair of side portions 43. The upper end portion 41 has a pair of upper corner portions 44. The lower end portion 42 has a pair of lower corner portions 45.

A pair of recessed grooves 46 respectively adjacent to the pair of lower corner portions 45 are formed in the lower end portion 42. The pair of recessed grooves 46 are opened downward. A projection 47 that projects downward between the pair of recessed groove 46 is formed on the lower end portion 42.

Also, a first connector 48 that forms a portion of a substrate-to-substrate connector is mounted to the inner surface 4*b* at the lower end portion 42. The first connector 48 includes an insulating body 48*a* fixed to the inner surface 4*b* of the LED substrate 4 and a plurality of contacts 48*b* held by the insulating body 48*a*. A lower half portion of the first connector 48 projects downward from the projection 47 of the lower end portion 42 of the LED substrate 4.

The lower half portion of the first connector 48 is fittingly connected to a second connector 71 (see FIG. 2 and FIG. 14) to be described below that is mounted to the power supply substrate 7.

Next, the outer globe 2 shall be described.

Figure 8:
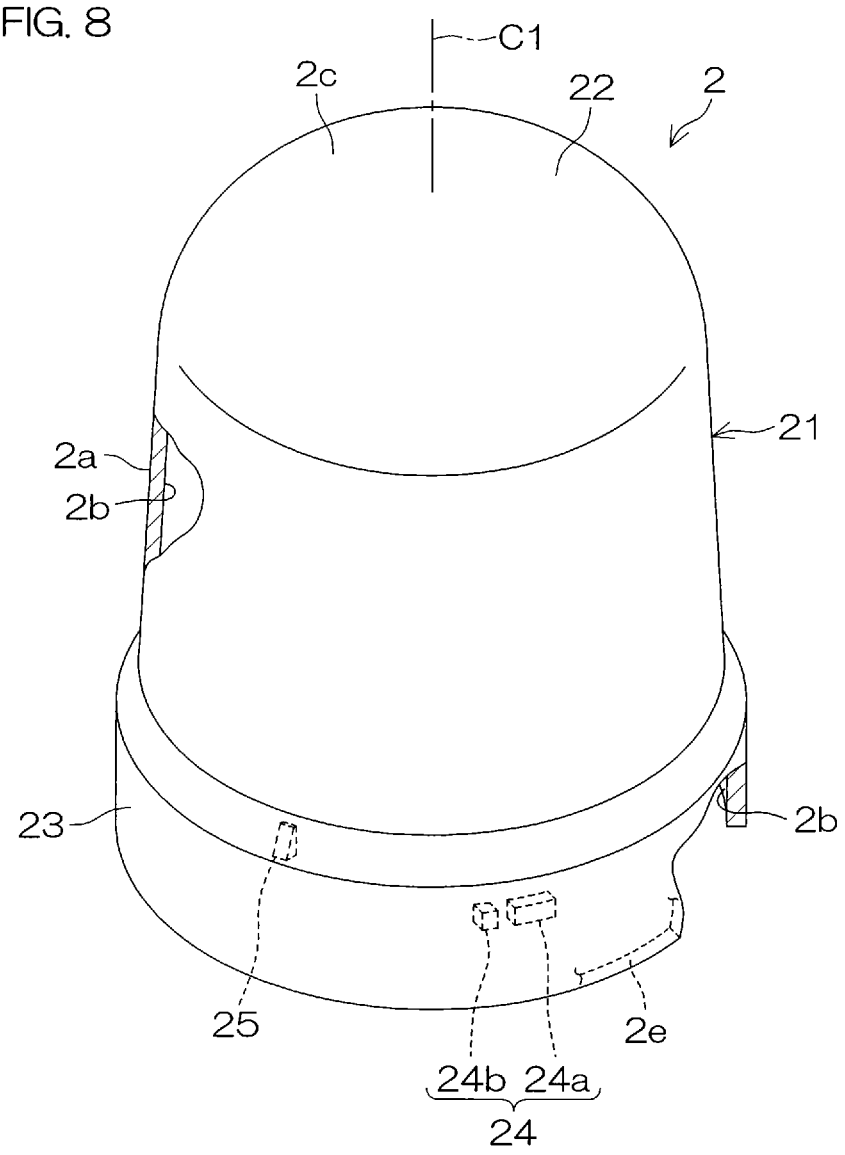
FIG. 8 is a partially broken away perspective view of an outer globe.

FIG. 8 is a partially broken away perspective view of the outer globe 2.

As shown in FIG. 8, the outer globe 2 is formed to a concave shape (substantially cylindrical shape) that is opened downward. The outer globe 2 includes a circumferential side wall 21 of cylindrical shape, a top wall 22 of dome shape, a fitting portion 23 constituted of a lower portion of the circumferential side wall 21, a plurality of engaging protrusions 24, and a plurality of positioning ribs 25.

As surface elements, the outer globe 2 includes an outer circumferential surface 2*a*, an inner circumferential surface 2*b*, an outer upper surface 2*c*, an inner upper surface 2*d* (see FIG. 1), and a lower end surface 2*e*. The outer circumferential surface 2*a* of the outer globe 2 corresponds to an outer circumferential surface of the circumferential side wall 21. The inner circumferential surface 2*b* of the outer globe 2 corresponds to an inner circumferential surface of the circumferential side wall 21. As shown in FIG. 1, the outer upper surface 2*c* corresponds to an outer surface of the top wall 22. The inner upper surface 2*d* corresponds to an inner surface of the top wall 22.

As shown in FIG. 8, the circumferential side wall 21 is formed to a cylindrical shape that is slightly enlarged in diameter toward the lower portion. The lower portion of the circumferential side wall 21 constitutes the fitting portion 23 of larger diameter than an upper portion. The fitting portion 23 is fitted onto the lower case 6 (see FIG. 2).

On the inner circumferential surface 2*b* at the fitting portion 23, the plurality of engaging protrusions 24 are disposed to be spaced apart in a circumferential direction. The engaging protrusions 24 include a first protrusion 24*a* and a second protrusion 24*b* that are spaced apart in the circumferential direction of the fitting portion 23. Also, on the inner circumferential surface 2*b* at the fitting portion 23, the plurality of positioning ribs 25 are disposed to be spaced apart in the circumferential direction. The positioning ribs 25 are disposed at higher positions than the engaging protrusions 24.

With the exception of the engaging protrusions 24, etc., the outer circumferential surface 2*a*, the inner circumferential surface 2*b*, the outer upper surface 2*c*, the inner upper surface 2*d*, and the lower end surface 2*e* of the outer globe 2 are formed of smooth surfaces and are excellent in aesthetic appearance. The outer globe 2 is formed, for example, to be of a red color that is translucent and is made high in visibility.

When the fitting portion 23 of the outer globe 2 is fitted onto the lower case 6, although not shown, the positioning ribs 25 contact an upper end surface 61*c* of a circumferential side wall 61 of the lower case 6 to position the outer globe 2 and the lower case 6 above and below (in a direction parallel to the central axis C1). Also, the engaging protrusions 24 are engagingly locked in a locking groove 65 (see FIG. 13) of the lower case 6.

Next, the inner globe 3 shall be described.

Figure 9:
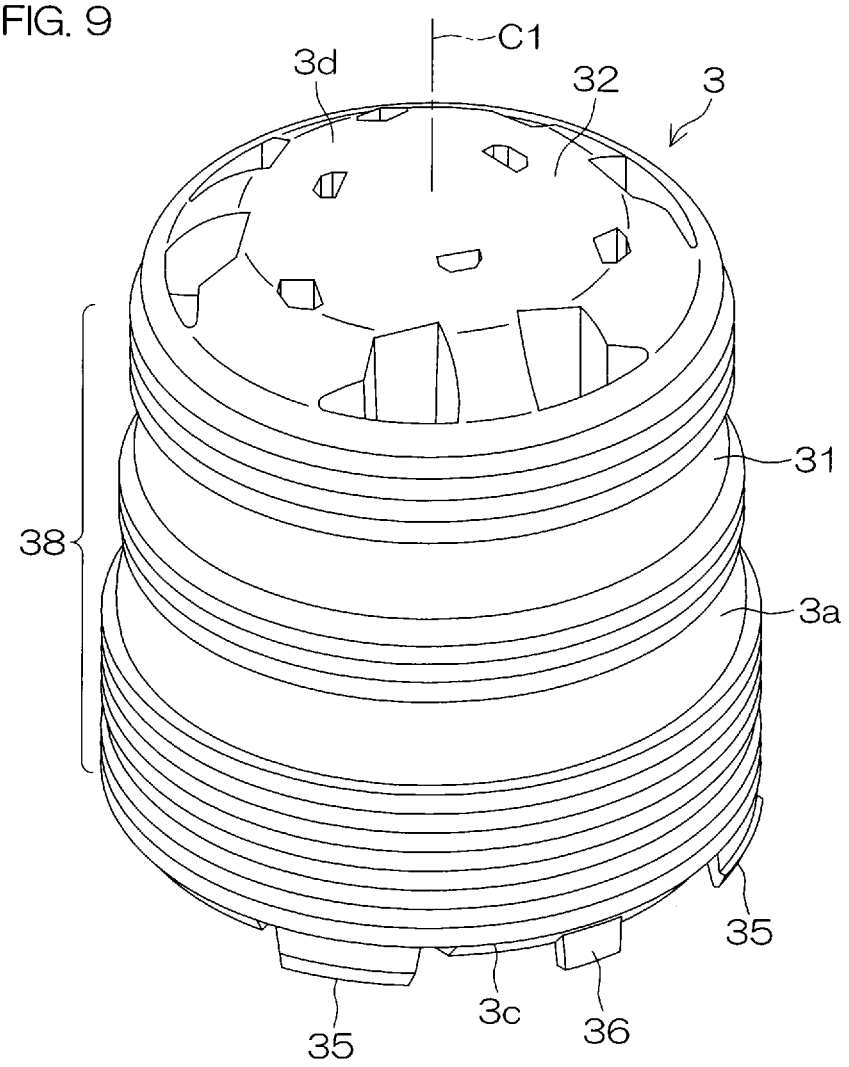
FIG. 9 is a perspective view of an inner globe.
Figure 10:
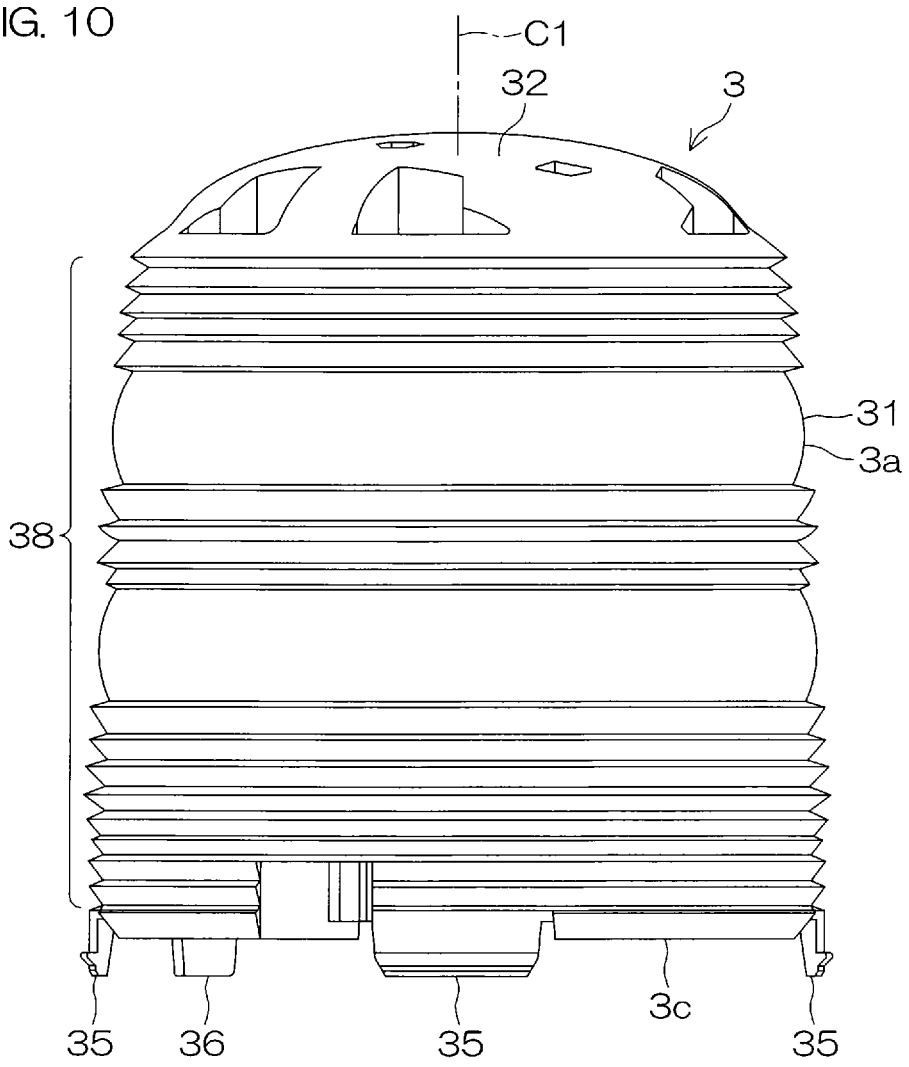
FIG. 10 is a front view of the inner globe.
Figure 11:
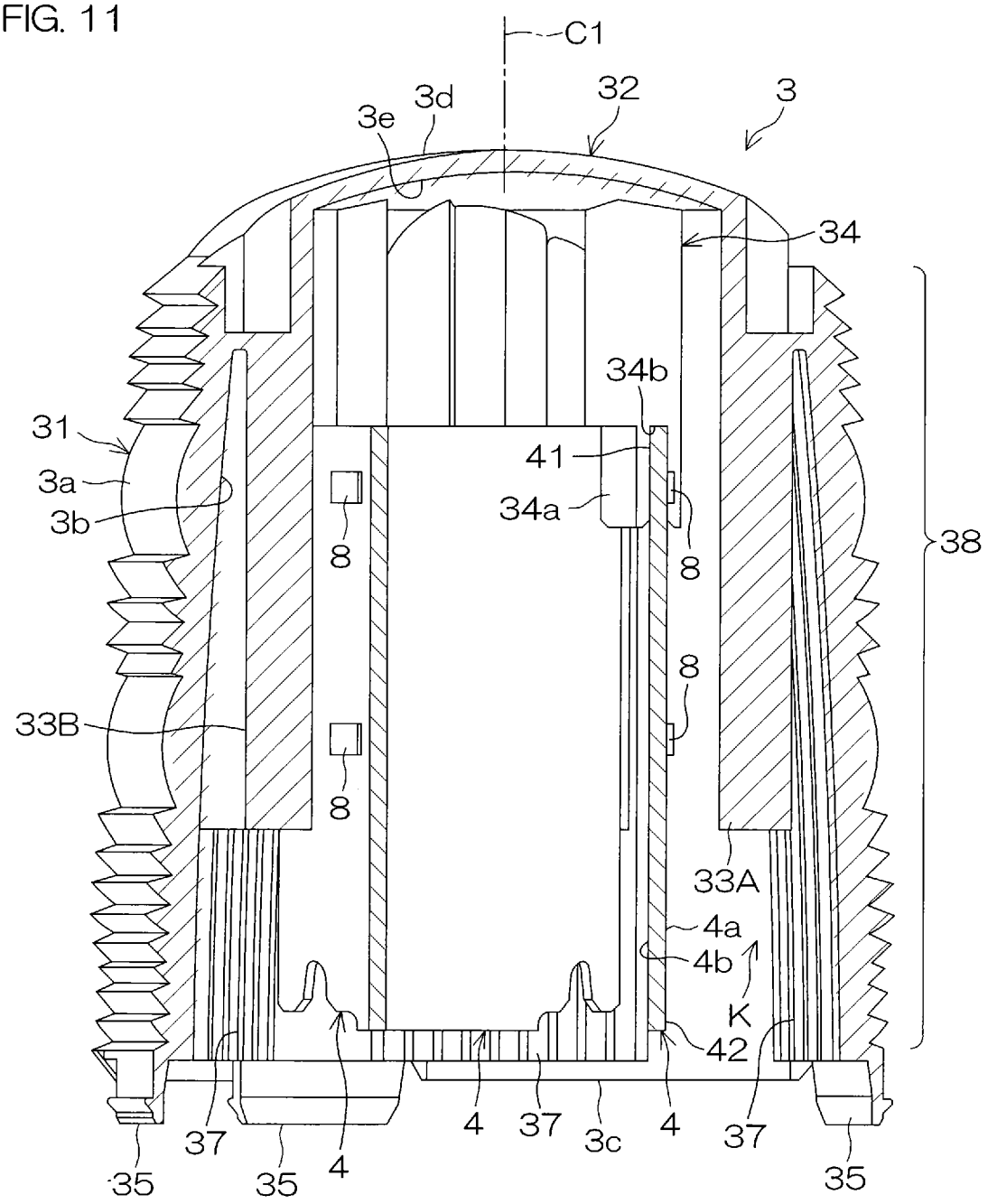
FIG. 11 is a sectional view of the inner globe with the LED substrates attached and corresponds to a sectional view taken on XI-XI of FIG. 3.
Figure 12:
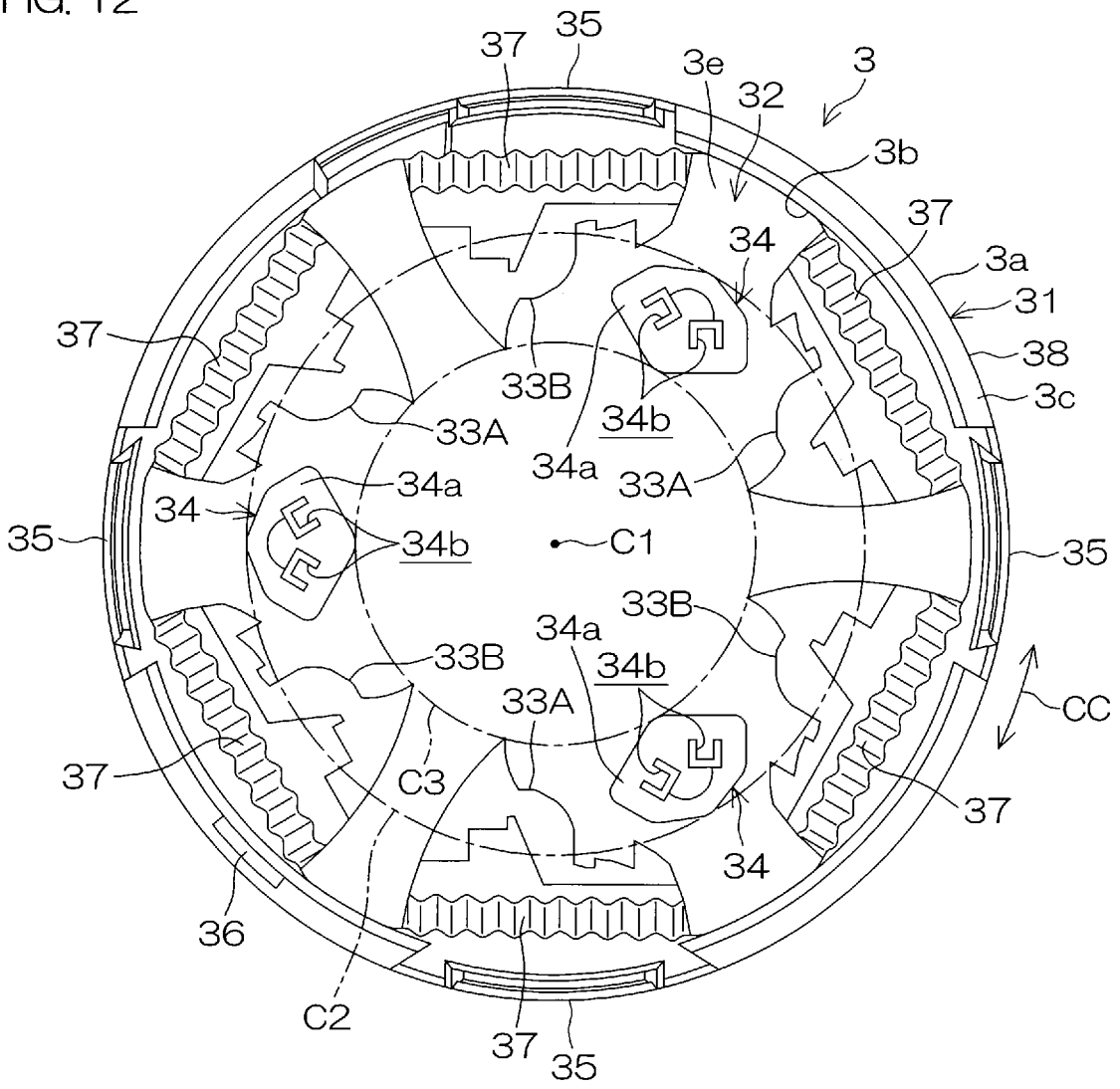
FIG. 12 is a bottom view of the inner globe.

FIG. 9 is a perspective view of the inner globe 3. FIG. 10 is a front view of the inner globe 3. FIG. 11 is a sectional view of the inner globe 3 with the LED substrates 4 attached and corresponds to a sectional view taken on XI-XI of FIG. 3. FIG. 12 is a bottom view of the inner globe 3.

As shown in FIG. 9 to FIG. 12, the inner globe 3 includes a circumferential side wall 31, a top wall 32, three pairs of columnar lenses 33A and 33B, three LED substrate supporting ribs 34 as LED substrate holding portions, a plurality of elastic claws 35, a single positioning tongue 36, six diffusing lenses 37, and a light collecting lens 38.

Specifically, the inner globe 3 forms a concave shape with the circumferential side wall 31 and the top wall 32. The circumferential side wall 31 is gradually reduced in diameter toward the top wall 32 side. The top wall 32 is formed to a dome shape.

As surface elements, the inner globe 3 includes an outer circumferential surface 3*a* (corresponding to an outer circumferential surface of the circumferential side wall 31), an inner circumferential surface 3*b* (corresponding to an inner circumferential surface of the circumferential side wall 31), a lower end surface 3*c* (corresponding to a lower end surface of the circumferential side wall 31), an outer upper surface 3*d* (corresponding to an outer surface of the top wall 32), and an inner upper surface 3*e* (corresponding to an inner surface of the top wall 32).

As shown in FIG. 3 and FIG. 7, the optical system K includes the pair of columnar lenses 33A and 33B respectively corresponding to the LEDs 8 disposed at the pair of placement positions Q1 of each LED substrate 4. As shown in FIG. 7, when viewed in parallel to the central axis C1, the columnar lens 33A and the columnar lens 33B are formed to shapes that are symmetrical with respect to the reference normal BN of the LED substrate 4.

In the following description, the pair of columnar lenses 33A and 33B, when referred to collectively, shall be referred to simply as the columnar lens 33.

As shown in FIG. 3, when viewed in parallel to the central axis C1, a circumscribing circle TSC passing through three vertices TS of the equilateral triangle T intersects the three pairs of columnar lenses 33A and 33B.

As shown in FIG. 3, the radiated lights from the LEDs 8 disposed at the pair of placement positions Q1 of each LED substrate 4 are converted via the corresponding columnar lenses 33A and 33B, the corresponding diffusing lens 37, and the light collecting lens 38 of the optical system K to the emitted parallel lights RPL that are respectively parallel to the pair of light emission reference lines RB passing through the central axis C1 at both sides sandwiching the reference normal BN of the LED substrate 4 and respectively contain the corresponding light emission reference lines RB.

As shown in FIG. 7, when viewed in parallel to the central axis C1, the pair of light emission reference lines RB with respect to each LED substrate 4 are inclined in mutually opposite directions at an inclination angle β with respect to the outer surface 4*a* of the LED substrate 4. The inclination angle β is 60°. Also, when viewed in parallel to the central axis C1, the pair of placement positions Q1 of each LED substrate 4 are disposed at outer sides of the pair of light emission reference lines RB with respect to the LED substrates 4.

As shown in FIG. 11, the columnar lenses 33A and 33B, the diffusing lenses 37, and the light collecting lens 38 that constitute the optical system K are provided integral to the inner globe 3.

The columnar lenses 33A and 33B are formed by columnar ribs extending from the inner upper surface 3*e* to a lower side (lower case 6 side) of the inner globe 3. As shown in FIG. 7, each pair of columnar lenses 33A and 33B collect and convert the radiated lights of the corresponding LEDs 8 to exiting parallel lights PL that are parallel to the corresponding light emission reference line RB.

Each of the columnar lenses 33A and 33B includes a first lens portion 11, a second lens portion 12, and a third lens portion 13.

As shown in FIG. 6 and FIG. 7, the first lens portion 11 includes a first incidence surface 11*a*, an internal reflection surface 11*b*, and a first exit surface 11*c*. The first incidence surface 11*a* takes in without refraction lights radiated to the reference normal side region A1. The internal reflection surface 11*b* is a paraboloid that totally reflects lights transmitted through the first incidence surface 11*a* to make these first internal parallel lights L1. The first exit surface 11*c* outputs without refraction the first internal parallel lights L1 from the internal reflection surface 11*b* as first exiting parallel lights PL1.

When viewed in parallel to the central axis C1, the first exit surface 11*c* is formed of a pair of planar surfaces 11*e* and 11*f* that are disposed insteps via a connecting portion 11*d* that is parallel to the emission reference line RB. The pair of planar surfaces 11*e* and 11*f* are planar surfaces that are orthogonal to the direction of the first internal parallel lights L1.

Of the pair of planar surfaces 11*e* and 11*f*, the one planar surface 11*e* at the second lens portion 12 side is disposed further to the central axis C1 side than the other planar surface 11*f*. Connection of the first exit surface 11*c* to a second exit surface 12*b* of the second lens portion 12 to be described later is thereby made easy while making the first lens portion 11 compact.

The second lens portion 12 includes a second incidence surface 12*a* and the second exit surface 12*b*. The second incidence surface 12*a* refracts and takes in lights radiated to the central region AC to make these second internal parallel lights L2. When viewed in parallel to the central axis C1, the second exit surface 12*b* is formed as a planar surface facing the connecting portion 11*d* side of the first lens portion 11. The second exit surface 12*b* refracts and outputs the second internal parallel lights L2 from the second incidence surface 12*a* to make these second exiting parallel lights PL2.

The third lens portion 13 includes a third incidence surface 13*a* and a third exit surface 13*b*. The third incidence surface 13*a* refracts and takes in lights radiated to the opposite side region A2 to make these third internal parallel lights L3. The third exit surface 13*b* is formed as a planar surface that is orthogonal to the direction of the third internal parallel lights L3. The third exit surface 13*b* outputs without refraction the third internal parallel lights L3 from the third incidence surface 13*a* as third exiting parallel lights PL3.

When viewed in parallel to the central axis C1, the first exiting parallel lights PL1 from the first lens portion 11, the second exiting parallel lights PL2 from the second lens portion 12, and the third exiting parallel lights PL3 from the third lens portion 13 are directed in the same direction that is the direction of the emission reference line RB. The exiting parallel lights PL from the respective columnar lenses 33A and 33B are constituted of the first exiting parallel lights PL1, the second exiting parallel lights PL2, and the third exiting parallel lights PL3.

As shown in FIG. 3, the diffusing lenses 37 are respectively formed in regions of the inner circumferential surface 3*b* of the inner globe 3 onto which the exiting parallel lights PL from the respective columnar lenses 33A and 33B are irradiated. The diffusing lenses 37 diffuse light in the peripheral direction CC of the central axis C1. As shown in FIG. 11, each diffusing lens 37 extends in the up/down direction and, as shown in FIG. 3, is formed of a large number of vertical ribs of semicircular cross-sectional shape that are disposed at equal intervals in a circumferential direction of the inner globe 3.

As shown in FIG. 9 to FIG. 11, the light collecting lens 38 is formed on an entire circumference of the outer circumferential surface 3*a* of the inner globe 3 that includes a region irradiated by the exiting parallel lights PL from the respective columnar lenses 33A and 33B (see FIG. 3) via the diffusing lenses 37. The light collecting lens 38 suppresses light from spreading in directions parallel to the central axis C1. The light collecting lens 38 is formed of a stepped Fresnel lens that forms an annular shape.

The plurality of elastic claws 35 and the single positioning tongue 36 are formed to project downward from the lower end surface 3*c* of the inner globe 3 (corresponding to the lower end surface of the circumferential side wall 31). As shown in FIG. 12, the plurality of elastic claws 35 are disposed at equal intervals in a circumferential direction of the circumferential side wall 31. The single positioning tongue 36 is disposed at a predetermined position of the circumferential side wall 31.

As shown in FIG. 11, each LED substrate supporting rib 34 is a columnar rib that extends in parallel to the central axis C1 from the inner upper surface 3*e* to the lower side (lower case 6 side) of the inner globe 3. As shown in FIG. 12, the three LED substrate supporting ribs 34 are disposed at equal intervals in a circumferential direction on a circumference centered on the central axis C1.

As shown in FIG. 11 and FIG. 12, a pair of insertion grooves 34*b* into which the adjacent upper corner portions 44 (see FIG. 4) of the pair of upper end portions 41 of the corresponding pair of LED substrates 4 are respectively inserted are formed in a lower end portion 34*a* of each LED substrate supporting rib 34. The inner globe 3 and the holder 5 of the base member B can thus be assembled in a state where the three LED substrates 4 are provisionally held by the inner globe 3 and ease of assembly is improved.

As shown in FIG. 12, the three LED substrate supporting ribs 34 are respectively disposed at three vertex portions of the equilateral triangle T (see FIG. 3) formed by the three LED substrates 4. As shown in FIG. 11, each LED substrate supporting rib 34 supports the upper end portions 41 of the LED substrates 4 that are adjacent at the vertex portion. The structure can thus be simplified.

The columnar lenses 33A and 33B of the optical system K and the LED substrate supporting ribs 34 are formed integral to the inner globe 3. Positional precision of the LEDs 8 and the corresponding columnar lenses 33A and 33B can thus be improved. Manufacturing cost can also be made inexpensive.

Also, the columnar lenses 33A and 33B and the LED substrate supporting ribs 34 are formed of ribs extending in parallel to the central axis C1 from the top wall 32 of the inner globe 3. Die forming using a synthetic resin is thus easy and the manufacturing cost can be made inexpensive.

As shown in FIG. 12, when viewed in parallel to the central axis C1, a circumscribing circle C2 of the three LED substrate supporting ribs 34 intersects the three pairs of columnar lenses 33A and 33B. Making of the inner globe 3 compact and making of the indicating lamp 1 compact can thus be achieved under a condition of using the LED substrates 4 that are the same. In other words, commonization of the LED substrates 4 can be achieved for indicating lamps 1 of various specifications that differ in outer diameter. The manufacturing cost can thus be made inexpensive by a mass production effect.

Although not shown, a layout in which an inscribed circle C3 of the three LED substrate supporting ribs 34 intersects the three pairs of columnar lenses 33A and 33B may also be adopted. In this case, the LED substrates 4 that are the same can be used to make the inner globe 3 more compact and consequently, specifications with which the indicating lamp 1 is made even more compact can be accommodated. In this case, the circumscribing circle C2 of the three LED substrate supporting ribs 34 may either intersect or not intersect the three pairs of columnar lenses 33A and 33B.

Next, the lower case 6 shall be described.

Figure 13:
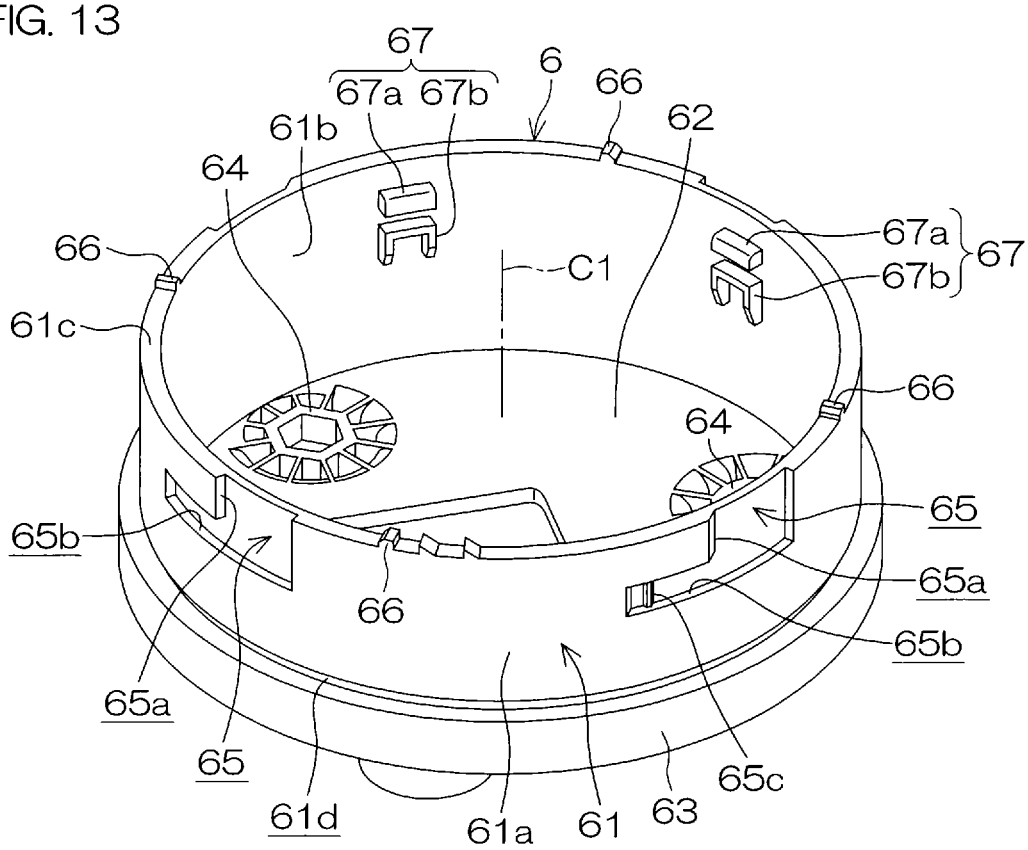
FIG. 13 is a perspective view of a lower case.

FIG. 13 is a perspective view of the lower case 6. As shown in FIG. 13, the lowercase 6 includes a circumferential side wall 61 of circular cylindrical shape, a bottom wall 62 of disk shape, an outwardly directed annular flange 63, a plurality of screw boss portions 64 for attachment to equipment, a plurality of locking grooves 65 and a plurality of locking protrusions 66 for locking the outer globe 2, and a plurality of locking protrusions 67 for locking the holder 5.

The circumferential side wall 61 includes an outer circumferential surface 61*a*, an inner circumferential surface 61*b*, and an annular upper end surface 61*c*. The annular flange 63 is formed to project radially outward from the outer circumferential surface 61*a* at a lower portion of the circumferential side wall 61. A housing groove 61*d* constituted of an outer circumferential groove in which an annular seal member (not shown) is housed is formed adjacent to the annular flange 63 in the outer circumferential surface 61*a* of the circumferential side wall 61.

The plurality of locking protrusions 66 are disposed to be spaced apart in a circumferential direction on the upper end surface 61*c* of the circumferential side wall 61. The plurality of locking protrusions 67 are disposed to be spaced apart in the circumferential direction on the inner circumferential surface 61*b* of the circumferential side wall 61. Each locking protrusion 67 is formed of an upper protrusion 67*a* and a lower protrusion 67*b* that are spaced apart above and below.

As shown in FIG. 2, the circumferential side wall 61 is insertion-fitted to the fitting portion 23 at the lower portion of the outer globe 2. Although not shown, in a state where the outer globe 2 is fitted onto the circumferential side wall 61, an interval between the inner circumferential surface 2*b* of the outer globe 2 at the fitting portion 23 and the outer circumferential surface 61*a* of the circumferential side wall 61 of the lower case 6 is sealed by the seal member (not shown) housed in the housing groove 61*d*. Waterproofness of the interior of the housing 9 is thereby secured.

As shown in FIG. 13, each locking groove 65 is a groove of L shape that is formed in the outer circumferential surface 61*a* of the circumferential side wall 61. Each locking groove 65 includes a vertical groove portion 65*a* and a lateral groove portion 65*b*. The vertical groove portion 65*a* extends downward from the upper end surface 61*c* of the circumferential side wall 61. The lateral groove portion 65*b* is extended to one side in the circumferential direction of the circumferential side wall 61 from a lower end of the vertical groove portion 65*a*. In the lateral groove portion 65*b* of at least one locking groove 65, a ride-over protrusion 65*c* is disposed in proximity to an extended end of the lateral groove portion 65*b*.

The outer globe 2 shown in FIG. 8 and the lower case 6 shown in FIG. 13 are attached as follows. That is, the outer globe 2 is moved relative to the lower case 6 in an axial direction to put the positioning ribs 25 of the outer globe in contact with the upper end surface 61*c* of the circumferential side wall 61 of the lower case 6. The outer globe 2 and the lower case 6 are thereby set in position in the direction parallel to the central axis C1. Also, the engaging protrusions 24 of the outer globe 2 are inserted inside the lateral groove portion 65*b* via the vertical groove portion 65*a*.

The outer globe 2 is then rotated relative to the lower case 6 to put the positioning ribs 25 of the outer globe 2 in contact with the corresponding locking protrusions 66 on the circumferential side wall 61 in the circumferential direction and set the outer globe 2 and the lower case 6 in position in the circumferential direction. Also, the engaging protrusions 24 are moved to the extended end of the lateral groove portion 65*b* and the second protrusion 24*b* of the engaging protrusions 24 rides over and becomes locked by the corresponding ride-over protrusion 65*c*. The outer globe 2 is thereby locked to the lower case 6.

Next, the power supply substrate 7 shall be described.

Figure 14:
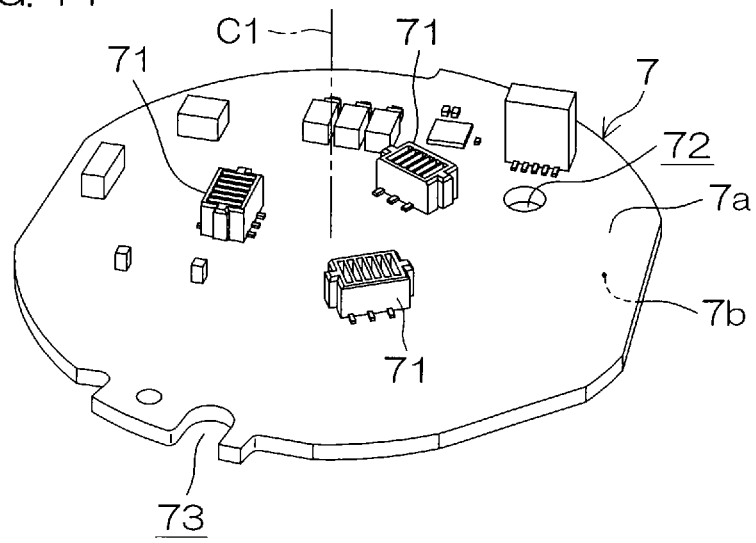
FIG. 14 is a perspective view of a power supply substrate.

FIG. 14 is a perspective view of the power supply substrate 7. As shown in FIG. 14, the power supply substrate 7 is formed to a substantially disk shape centered on the central axis C1. The power supply substrate 7 includes an upper surface 7*a*, a lower surface 7*b*, three second connectors 71, a fixing screw insertion hole 72, and a fixing screw insertion groove 73.

Although not shown, a power supply circuit that is arranged to supply power to the LED substrates 4 and a control circuit that controls the supplying of power are mounted on the upper surface 7*a* and the lower surface 7*b* of the power supply substrate 7.

The three second connectors 71 are mounted on the upper surface 7*a*. The three second connectors 71 are disposed in an annular shape centered on the central axis C1.

The lower half portions of the first connectors 48 (see FIG. 4 and FIG. 5) of the three LED substrates 4 are respectively fitted and connected to the three second connectors 71 mounted on the power supply substrate 7. The contacts 48*b* of each first connector 48 is thereby connected to contacts (not shown) of the corresponding second connector 71.

By fixing screws (not shown) inserted through the fixing screw insertion hole 72 and the fixing screw insertion groove 73 being screwed into screw bosses (not shown) on a lower surface 54*b* of a second pedestal portion 54 (see FIG. 15) of the holder 5, the power supply substrate 7 is fixed to the lower surface 54*b* of the second pedestal portion 54 of the holder 5.

Next, the holder 5 shall be described.

Figure 15:
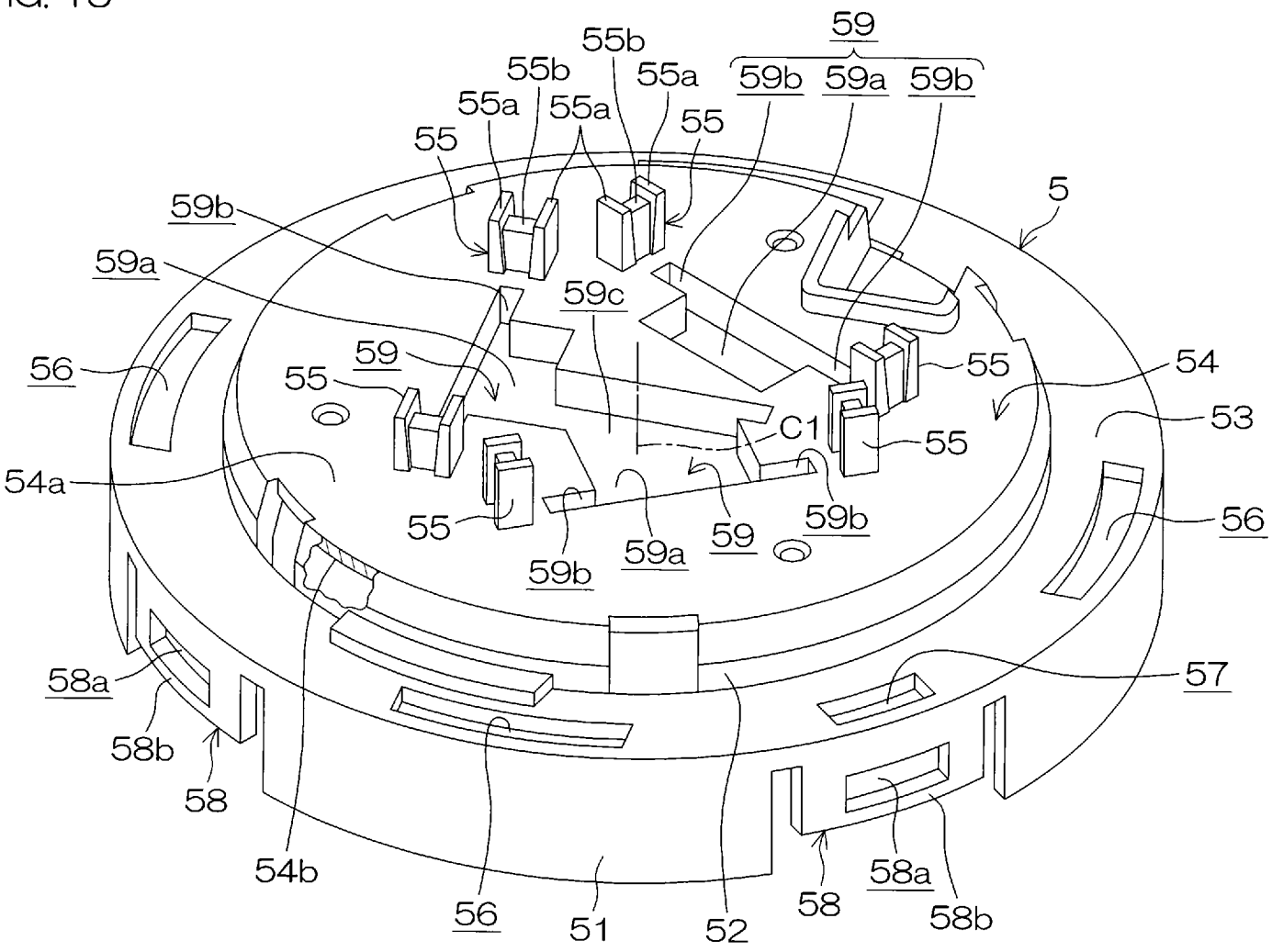
FIG. 15 is a perspective view of a holder.
Figure 16:
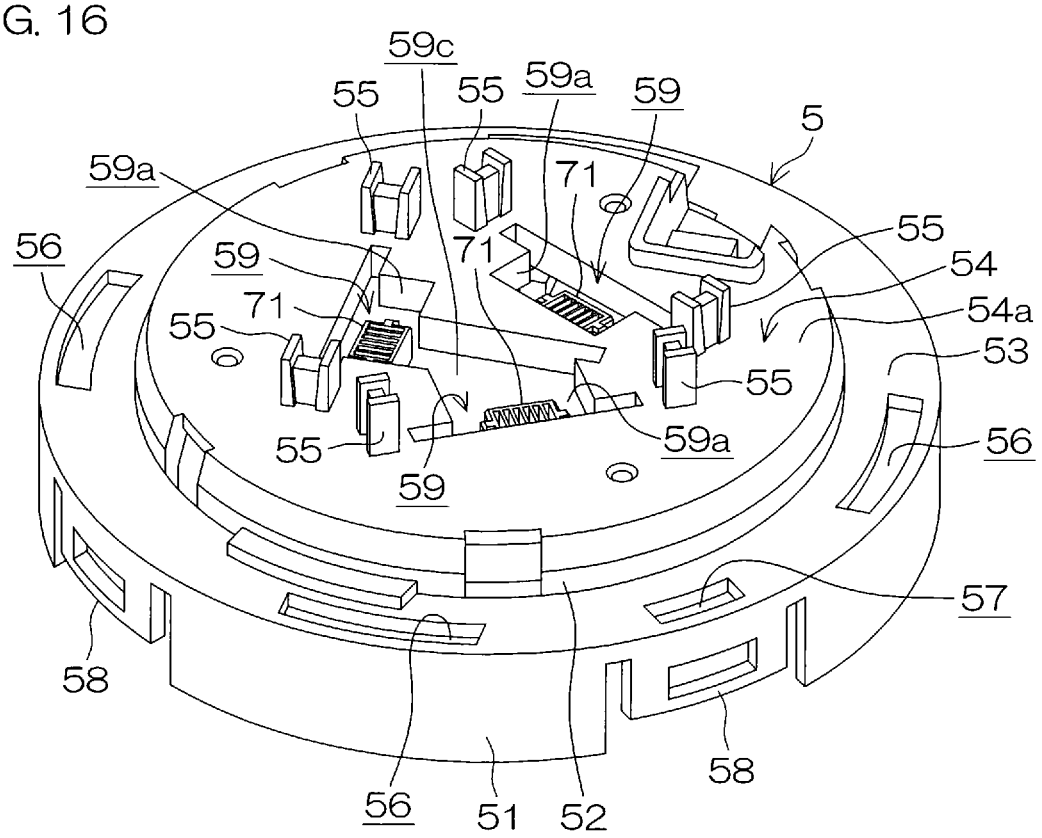
FIG. 16 is a perspective view of the holder with the power supply substrate attached.
Figure 17:
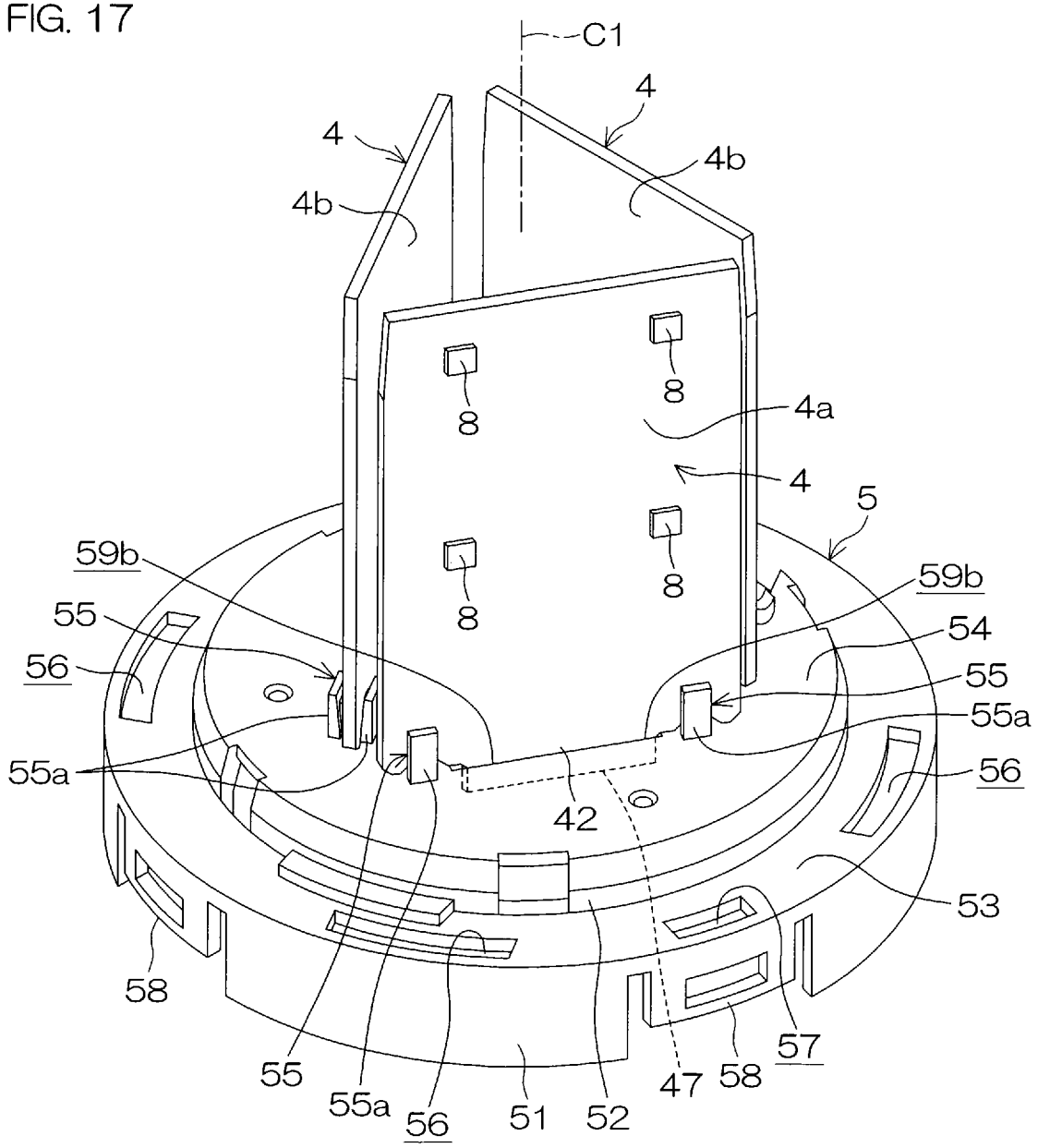
FIG. 17 is a perspective view of an attached state of the holder and the LED substrates.

FIG. 15 is a perspective view of the holder 5. FIG. 16 is a perspective view of the holder 5 with the power supply substrate 7 attached. FIG. 17 is a perspective view of an attached state of the holder 5 and the LED substrates 4.

As shown in FIG. 15, the holder 5 includes a first circular cylindrical portion 51, a second circular cylindrical portion 52, an annular first pedestal portion 53, the disk shaped second pedestal portion 54, three pairs of LED substrate supporting ribs 55, a plurality of elastic claw insertion grooves 56, a positioning tongue insertion groove 57, a plurality of elastic hooks 58, and three opening portions 59.

The first circular cylindrical portion 51 and the second circular cylindrical portion 52 are concentric circular cylinders centered on the central axis C1 and the second circular cylindrical portion 52 is smaller in diameter than the first circular cylindrical portion 51.

The first pedestal portion 53 is formed of an annular plate that is extended radially inward from an upper end of the first circular cylindrical portion 51. The plurality of elastic claw insertion grooves 56 and the positioning tongue insertion groove 57 are formed in the first pedestal portion 53.

The plurality of elastic claw insertion grooves 56 are disposed at equal intervals in a circumferential direction.

The second circular cylindrical portion 52 is extended upward from an inner edge portion of the annular first pedestal portion 53. The disk shaped second pedestal portion 54 is extended radially inward from an upper edge portion of the first pedestal portion 53. The second pedestal portion 54 has an upper surface 54*a* (first surface) at the LED substrate 4 side and the lower surface 54*b* (second surface).

The three opening portions 59 are formed in the second pedestal portion 54. The respective opening portions 59 are disposed in an equilateral triangular shape. Each opening portion 59 is formed to a T shape having a connecter insertion portion 59*a* and a pair of substrate insertion portions 59*b* extended to both sides from the connector insertion portion 59*a*. The connector insertion portions 59*a* of two opening portions 59 among the three opening portions 59 are put in communication via a communication groove 59*c*.

As shown in FIG. 16, the corresponding second connector 71 of the power supply substrate 7 is disposed below the connector insertion portion 59*a* of each opening portion 59.

The lower half portion of the first connector 48 of the corresponding LED substrate 4 is inserted through each connector insertion portion 59*a*. Thereby, although not shown, the first connector 48 of each LED substrate 4 is fitted and connected to the corresponding second connector 71 through the connector insertion portion 59*a* of the corresponding opening portion 59. Also, in this state, the lower end portion 42 of the corresponding LED substrate 4 is inserted through the pair of substrate insertion portions 59*b* as shown in FIG. 17. The lower end portion 42 of the LED substrate 4 is thereby set in position in a direction orthogonal to the LED substrate 4 with respect to the holder 5.

As shown in FIG. 15, the three pairs of LED substrate supporting ribs 55 are formed projectingly on the upper surface 54*a* of the second pedestal portion 54. Each pair of LED substrate supporting ribs 55 are disposed at both sides sandwiching the corresponding opening portion 59.

Each LED substrate supporting rib 55 includes a pair of first ribs 55*a* that are parallel to the corresponding side of the equilateral triangle T (see FIG. 3) and are spaced apart from each other and a second rib 55*b* that orthogonally connects the pair of first ribs 55*a* together. The pair of first ribs 55*a* and the second rib 55*b* form an H shape in plan view. A height of the second rib 55*b* from the upper surface 54*a* of the second pedestal portion 54 is made lower than a height of the first ribs 55*a*.

As shown in FIG. 16 and FIG. 17, the second rib 55*b* of the corresponding LED substrate supporting rib 55 is inserted into each recessed groove 46 (see FIG. 4) of the lower end portion 42 of each LED substrate 4. Each LED substrate 4 is thereby restricted in moving along the corresponding side of the equilateral triangle when viewed in parallel to the central axis C1. The pair of first ribs 55*a* serve a function of guiding the insertion of the second rib 55*b* into each recessed groove 46.

Also, as shown in FIG. 17, a pair of edge portions of the projection 47 (see FIG. 4) of the lower end portion 42 of each LED substrate 4 are inserted into the pair of substrate insertion portions 59*b* (see FIG. 15) of the corresponding opening portion 59.

Although not shown, when the inner globe 3 is attached to the holder 5, the inner globe 3 is accurately set in position in the circumferential direction with respect to the holder 5 at a position enabling insertion of the positioning tongue 36 of the inner globe 3 into the positioning tongue insertion groove 57 of the first pedestal portion 53 of the holder 5.

Although not shown, in the state of positioning by the positioning tongue 36, the respective elastic claws 35 of the inner globe 3 are inserted through the corresponding elastic claw insertion grooves 56 of the first pedestal portion of the holder 5. The elastic claws 35 are thereby elastically hooked and locked to edge portions of the elastic claw insertion grooves 56. The inner globe 3 is thereby locked with respect to the holder 5 in a state where the lower end surface 3*c* (corresponding to the lower end surface of the circumferential side wall 31) of the inner globe 3 contacts an upper surface of the first pedestal portion 53.

As shown in FIG. 15, the plurality of elastic hooks 58 are formed of a portion of the first circular cylindrical portion 51. Each elastic hook 58 is a hook of cantilever shape with an upper end being a fixed end and a lower end being a free end. The elastic hook 58 forms an engaging groove 58*a* of rectangular shape. Also, with the elastic hook 58, a locking edge portion 58*b* is formed by a lower edge portion of the engaging groove 58*a*.

When the holder 5 shown in FIG. 15 is attached to the lower case 6 shown in FIG. 13, although not shown, in accompaniment with the insertion-fitting of the first circular cylindrical portion 51 of the holder 5 to the circumferential side wall 61 of the lower case 6, the locking edge portions 58*b* ride over and lock the upper protrusions 67*a* of the locking protrusions 67 of the lower case 6 and the upper protrusion 67*a* of the lower case 6 are fitted in the engaging grooves 58*a* of the elastic hooks 58. Also, the locking edge portions 58*b* of the holder 5 become restricted in downward movement by the lower protrusions 67*b* of the lower case 6. The holder 5 is thereby locked in a position set state with respect to the lower case 6.

Also, assembly procedures of the indicating lamp 1 are as follows. That is, first, as shown in FIG. 11, in a state where the upper end portions 41 of the respective LED substrates 4 are supported by the corresponding LED substrate supporting ribs 34 of the inner globe 3, the inner globe 3 is installed on the holder 5. In this installation process, the lower end portions 42 of the LED substrate 4 are supported by the corresponding LED substrate supporting ribs 55 of the holder 5.

The LED substrates 4 are supported above and below by the LED substrate supporting ribs 34 of the inner globe 3 and the LED substrate supporting ribs 55 of the holder 5 and are therefore supported with good positional precision with respect to the inner globe 3 and the holder 5.

Next, the power supply substrate 7 is installed on the lower surface 54*b* of the second pedestal portion 54 of the holder 5. In this installation process, the respective second connectors 71 of the power supply substrate 7 and the first connectors 48 of the corresponding LED substrates 4 are coupled as substrate-to-substrate connectors.

Next, the holder 5 is installed on the lower case 6 to form the base member B. Lastly, the outer globe 2 is installed on the lower case 6 to assemble the indicating lamp 1.

In the present preferred embodiment, as shown in FIG. 3, the radiated lights of the LEDs 8 disposed at the pair of placement positions Q1 in each of the three LED substrates 4 that form the equilateral triangle are converted to and radially emitted as the emitted parallel lights RPL that are respectively parallel to the pair of light emission reference lines RB passing through the central axis C1 at both sides of the reference normal BN to each LED substrate 4 and respectively contain the corresponding light emission reference lines RB. An appearance of light being emitted from the position of the central axis C1 of the indicating lamp 1 can thus be visualized. Consequently, visibility can be improved inexpensively using a small number of the LED substrates 4 and a small number of the LEDs 8.

Also, as shown in FIG. 3 and FIG. 7, the optical system K includes the three pairs of columnar lenses 33A and 33B that are disposed in the annular shape centered on the central axis C1. Each pair of columnar lenses 33A and 33B respectively take in the radiated lights from the LEDs 8 at the pair of placement positions Q1 of the corresponding LED substrate 4 and output exiting parallel lights PL that, when viewed in parallel to the central axis C1, are respectively parallel to the corresponding light emission reference lines RB. Optical design for emitting the parallel lights PL parallel to the light emission reference lines RB that pass through the central axis C1 is thereby made easy.

Also, the respective columnar lenses 33A and 33B are disposed with gaps provided between each other. It is thus made possible to use back surfaces of facing surfaces between the columnar lenses 33A and 33B (specifically, the internal reflection surfaces 11*b* of the first lens portions 11) as optical elements. Degree of freedom of design is thus increased.

Also, as shown in FIG. 3, when viewed in parallel to the central axis C1, the circumscribing circle TSC passing through the vertices TS of the equilateral triangle T intersects the three pairs of columnar lenses 33A and 33B. In this case, the making of the inner globe 3 compact and the making of the indicating lamp 1 compact can be achieved under the condition of using the LED substrates 4 that are the same. In other words, commonization of the LED substrates 4 can be achieved for indicating lamps 1 of various specifications that differ in outer diameter. The manufacturing cost can thus be made inexpensive by the mass production effect.

Also, the translucent inner globe 3 (globe G) of cylindrical shape that surrounds the three LED substrates 4 and the three pairs of columnar lenses 33A and 33B and is centered on the central axis C1 is included and the inner globe 3 and the columnar lenses 33A and 33B are formed integrally. The number of parts can be reduced and the manufacturing cost can be made inexpensive.

Also, the optical system K includes the diffusing lenses 37 and the light collecting lens 38 that are provided on the globe G. The diffusing lenses 37 diffuse the exiting lights from the columnar lenses 33A and 33B in the circumferential direction of the globe G. The light collecting lens 38 suppresses the exiting lights from the columnar lenses 33A and 33B from spreading in the directions parallel to the central axis C1. Light can thus be emitted effectively in a required range.

Specifically, the globe G includes the inner globe 3 that has the inner circumferential surface 3*b* on which the diffusing lenses 37 are formed and the outer circumferential surface 3*a* on which the Fresnel lens is formed as the light collecting lens 38 and the outer globe 2 that surrounds the inner globe 3. The optical system K is arranged collectively in the inner globe 3 and with the outer globe 2, the outer circumferential surface 2*a* and the inner circumferential surface 2*b* can be formed of smooth surfaces. Design quality can thus be improved.

Also, as shown in FIG. 6 and FIG. 7, when viewed in parallel to the central axis C1, the pair of placement positions Q1 on the outer surface 4*a* of each LED substrate 4 are positions that are symmetrical with respect to the reference normal BN of the LED substrate 4. The LED substrates 4 can thus be commonized favorably.

Also, as shown in FIG. 7, when viewed in parallel to the central axis C1, the pair of light emission reference lines RB with respect to each LED substrate 4 are disposed symmetrically with respect to the reference normal BN of the LED substrate 4. The emitted parallel lights RPL (see FIG. 3) that are uniform can thus be obtained.

Also, as shown in FIG. 7, when viewed in parallel to the central axis C1, the pair of light emission reference lines RB with respect to each LED substrate 4 are inclined in mutually opposite directions at the inclination angle β of 60° with respect to the outer surface 4*a* of the LED substrate 4. The emitted parallel lights RPL (see FIG. 3) that are uniform can thus be obtained.

Also, as shown in FIG. 7, when viewed in parallel to the central axis C1, the pair of placement positions Q1 on each LED substrate 4 are disposed at outer sides of the pair of light emission reference lines RB with respect to the LED substrate 4. Distance can thus be secured between the LEDs 8 at the pair of placement positions Q1. Attachment of the LEDs 8 onto the LED substrate 4 during manufacture is thus made easy.

Also, as shown in FIG. 4, the plurality of LEDs 8 are aligned in the single column in the direction parallel to the central axis C1 at each of the pair of placement positions Q1 of each LED substrate 4. An indicating range can thus be made wide.

Also, as shown in FIG. 6, when viewed in parallel to the central axis C1, the effective radiation region A of each LED 8 includes the central region AC through which the optical axis 8*a* of the LED 8 passes, the reference normal side region A1 that is the reference normal BN side with respect to the central region AC, and the opposite side region A2 at the opposite side to the reference normal side region A1. Also, as shown in FIG. 7, each of the columnar lenses 33A and 33B includes the first lens portion 11, the second lens portion 12, and the third lens portion 13.

The first lens portion 11 takes in the lights radiated from the corresponding LED 8 to the reference normal side region A1 and outputs the first exiting parallel lights PL1. The second lens portion 12 takes in the lights radiated from the corresponding LED 8 to the central region AC and outputs the second exiting parallel lights PL2. The third lens portion 13 takes in the lights radiated from the corresponding LED 8 to the opposite side region A2 and outputs the third exiting parallel lights PL3. The first exiting parallel lights PL1, the second exiting parallel lights PL2, and the third exiting parallel lights PL3 are directed in the same direction. The lights from the effective radiation region of the LED 8 can thus be converted to the exiting parallel lights PL1 to PL3 directed in the same direction by the lens portions 11 to 13 that are in accordance with radiation directions.

Also, the first lens portion 11 includes the first incidence surface 11*a*, the internal reflection surface 11*b*, and the first exit surface 11*c*. The first incidence surface 11*a* takes in without refraction the lights radiated to the reference normal side region A1. The internal reflection surface 11*b* is a paraboloid that totally reflects the lights transmitted through the first incidence surface 11*a* to make these the first internal parallel lights L1. The first exit surface 11*c* outputs without refraction the first internal parallel lights L1 from the internal reflection surface 11*b* as the first exiting parallel lights PL1. The lights radiated to the reference normal side region A1 from the LED 8 can thus be collected and guided by the total reflection by the internal reflection surface 11*b* to the side opposite to the reference normal BN side.

Also, the second lens portion 12 includes the second incidence surface 12*a* and the second exit surface 12*b*. The second incidence surface 12*a* refracts and takes in the lights radiated to the central region AC to make these the second internal parallel lights L2. The second exit surface 12*b* refracts and outputs the second internal parallel lights L2 from the second incidence surface 12*a* to make these the second exiting parallel lights PL2. The lights radiated to the central region AC from the LED 8 can thus be collected and changed in direction.

Also, the third lens portion 13 includes the third incidence surface 13*a* and the third exit surface 13*b*. The third incidence surface 13*a* refracts and takes in the lights radiated to the opposite side region A2 to make these the third internal parallel lights L3. The third exit surface 13*b* outputs without refraction the third internal parallel lights L3 from the third incidence surface 13*a* as the third exiting parallel lights PL3. The lights radiated to the opposite side region A2 from the LED 8 can thus be collected and changed in direction.

Also, the third incidence surface 13*a* is a Fresnel surface. Making of the columnar lenses 33A and 33B compact can thus be achieved.

Also, as shown in FIG. 2 and FIG. 11, the globe G that surrounds the three LED substrates 4 and the three pairs of columnar lenses 33A and 33B and the base member B coupled to an opening end of the globe G are included. The base member B includes the LED substrate supporting ribs 55 that support the lower end portions 42 of the LED substrates 4. The three LED substrates 4 can thus be supported in a state of an equilateral triangular configuration.

Also, the power supply substrate 7 supported by the base member B (specifically, the holder 5) is included. The three first connectors (see FIG. 5) respectively disposed at the lower end portions 42 of the three LED substrates 4 and the three second connectors 71 (see FIG. 14 and FIG. 17) disposed at the power supply substrate 7 are coupled as the substrate-to-substrate connectors. Power can thus be supplied to the LED substrates 4 without using an electric wire from the power supply substrate 7. The structure can thus be simplified.

Second Preferred Embodiment

Figure 18:
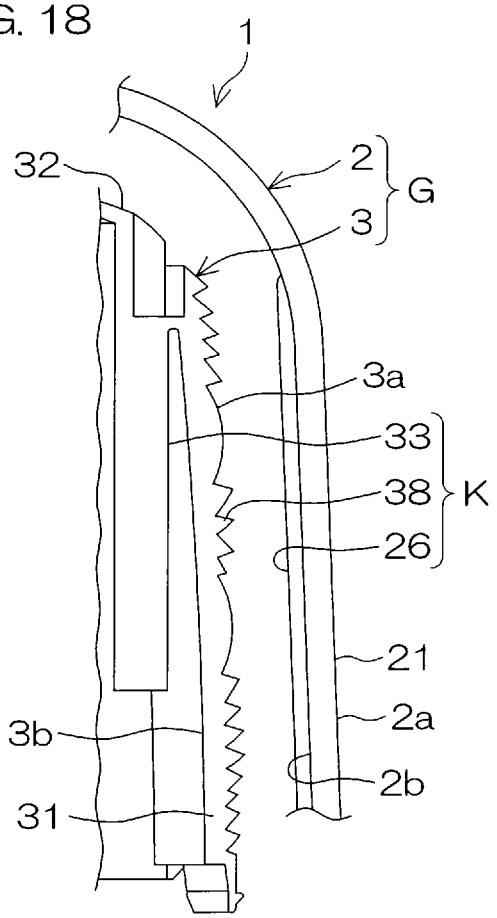
FIG. 18 is a general sectional view of principal portions of a globe of an indicating lamp according to a second preferred embodiment of the present invention.

FIG. 18 is a vertical sectional view of the globe G of the indicating lamp 1 according to a second preferred embodiment of the present invention.

With the second preferred embodiment of FIG. 18, the globe G includes the inner globe 3 having the outer circumferential surface 3*a* on which a Fresnel lens is formed as the light collecting lens 38 and the outer globe 2 having the inner circumferential surface 2*b* on which a diffusing lens 26 is formed and surrounding the inner globe 3.

The light collecting lens 38 suppresses light from spreading in the directions parallel to the central axis C1. The light collecting lens 38 is formed of a stepped Fresnel lens that forms an annular shape. The diffusing lens 26 makes lights made incident from the light collecting lens 38 exit such as to be diffused in the peripheral direction CC of the central axis C1.

The inner circumferential surface 3*b* of the inner globe 3 is formed as smooth surface. The outer circumferential surface 2*a* of the outer globe 2 is formed as smooth surface and is excellent in design quality.

The diffusing lens 26 of the outer globe 2 is of the same arrangement as the diffusing lenses 37 of the inner globe 3 of the first preferred embodiment and is formed of vertical ribs of semicircular cross-sectional shape that extend in parallel to the central axis C1. The optical system K is arranged by a columnar lens 33 and the light collecting lens 38 of the inner globe 3 and the diffusing lens 26 of the outer globe 2.

In this preferred embodiment, since a Fresnel lens is not formed on any of the inner circumferential surfaces of the globe G (the inner circumferential surface 2*b* of the outer globe 2 and the inner circumferential surface 3*b* of the inner globe 3), manufacture is made easy in a case where the globe G is to be resin molded. Also, the degree of freedom of design can be improved.

Third Preferred Embodiment

Figure 19:
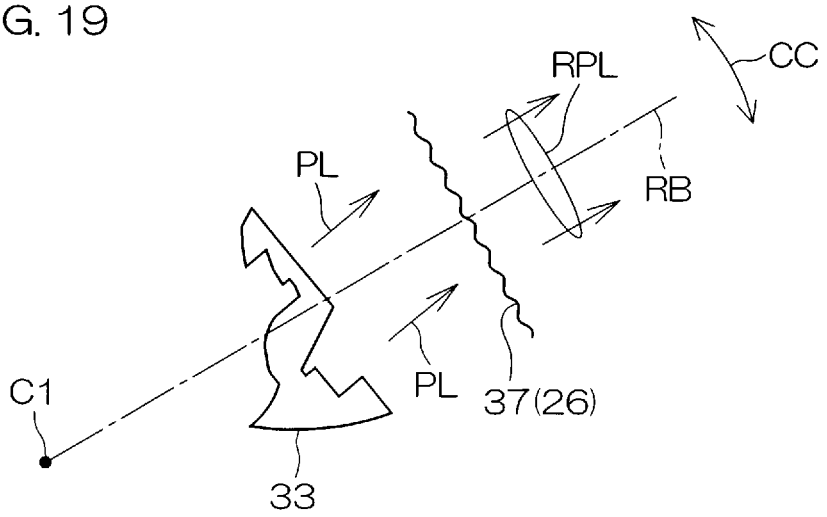
FIG. 19 is a schematic view showing a relationship between emitted parallel lights and exiting parallel lights from a columnar lens in a third preferred embodiment of the present invention.

FIG. 19 is a schematic view showing a relationship between emitted parallel lights RPL and exiting parallel lights PL from a columnar lens 33 in a third preferred embodiment of the present invention.

As shown in FIG. 19, the exiting parallel lights PL from the columnar lens are inclined with respect to the light emission reference line RB. The exiting parallel lights PL from the columnar lens are converted while being diffused in the peripheral direction CC by a diffusion lens 37 of the same arrangement as the first preferred embodiment (or a diffusion lens 26 of the same arrangement as the second preferred embodiment) to the emitted parallel lights RPL that are parallel to the light emission reference line RB. With this preferred embodiment, the degree of freedom of design can be improved.

Also, with the present invention, the outer globe 2 may be omitted and a portion of an outer contour of the indicating lamp 1 may be formed by the inner globe 3.

Also, when viewed in parallel to the central axis C1, the inclination angle β (see FIG. 7) that the pair of light emission reference lines RB with respect to each LED substrate 4 form with the outer surface 4*a* of the LED substrate 4 may be greater than 60° or may be less than 60°.

Also, although not shown, three or more LEDs 8 may be juxtaposed in a single column in a direction parallel to the central axis C1 at each of the pair of placement positions Q1 of each LED substrate 4 (see FIG. 4).

Also, with the indicating lamp 1 of the present invention, control of making the LED 8 at each placement position Q1 lit and unlit can be performed successively on the LEDs 8 that are adjacent each other in the peripheral direction CC of the central axis C1 to make the light function as a simulated rotating light.

Although the present invention has been described in detail by way of specific modes above, persons of skill in the art who have understood the above contents would easily conceive of changes, modifications, and equivalents thereto. The present invention should thus be deemed to be of the scope of the claims and the scope of equivalents thereof.

REFERENCE SIGNS LIST

1 . . . indicating lamp
2 . . . outer globe
2*a* . . . outer circumferential surface
2*b* . . . inner circumferential surface
3 . . . inner globe
3*a* . . . outer circumferential surface
3*b* . . . inner circumferential surface
4 . . . LED substrate
4*a* . . . outer surface
5 . . . holder
6 . . . lower case
7 . . . power supply substrate

8 . . . LED
8*a* . . . optical axis
11 . . . first lens portion
11*a* . . . first incidence surface
11*b* . . . internal reflection surface
11*c* . . . first exit surface
12 . . . second lens portion
12*a* . . . second incidence surface
12*b* . . . second exit surface
13 . . . third lens portion
13*a* . . . third incidence surface
13*b* . . . third exit surface
31 . . . circumferential side wall
32 . . . top wall
33A . . . columnar lens
33B . . . columnar lens
34 . . . LED substrate supporting rib
34*a* . . . lower end portion
34*b* . . . insertion groove
41 . . . upper end portion (one end portion)
42 . . . lower end portion (other end portion)
44 . . . upper corner portion
45 . . . lower corner portion
48 . . . first connector
51 . . . first circular cylindrical portion
52 . . . second circular cylindrical portion
53 . . . first pedestal portion
54 . . . second pedestal portion
54*a* . . . upper surface (first surface)
54*b* . . . lower surface (second surface)
55 . . . LED substrate supporting rib
55*a* . . . first rib
55*b* . . . second rib
59 . . . opening portion
59*a* . . . connector insertion portion
59*b* . . . substrate insertion portion
61 . . . circumferential side wall
62 . . . bottom wall
63 . . . annular flange
71 . . . second connector
A . . . effective radiation region
AC . . . central region
A1 . . . reference normal side region
A2 . . . opposite side region
B . . . base member
BN . . . reference normal
C1 . . . central axis
G . . . globe
K . . . optical system
L1 . . . first internal parallel light
L2 . . . second internal parallel light
L3 . . . third internal parallel light
PL1 . . . first exiting parallel light
PL2 . . . second exiting parallel light
PL3 . . . third exiting parallel light
Q1 . . . placement position
RB . . . light emission reference line
RPL . . . emitted parallel light
T . . . equilateral triangle
TS . . . vertex
TSC . . . circumscribing circle
β . . . inclination angle
θ . . . central angle

The invention claimed is:

1. An indicating lamp emitting light radially toward a periphery of a central axis and away from the central axis and comprising:

three LED substrates that, when viewed in parallel to the central axis, form an equilateral triangle surrounding the central axis and are disposed equidistantly with respect to the central axis;

LEDs that, when viewed in parallel to the central axis, are disposed on an outer surface of each LED substrate at least one each at each of a pair of placement positions at both sides sandwiching a reference normal being a normal to the outer surface of each LED substrate and passing through the central axis and each have an optical axis orthogonal to the outer surface of each LED substrate; and an optical system by which, when viewed in parallel to the central axis, radiated lights from the LEDs at the pair of placement positions of each LED substrate are converted to and emitted as emitted parallel lights that are respectively parallel to a pair of light emission reference lines passing through the central axis at both sides sandwiching the reference normal of each LED substrate and respectively contain the corresponding light emission reference lines.

2. The indicating lamp according to claim 1, wherein the optical system includes six columnar lenses disposed annularly around the central axis and extending in parallel to the central axis and the six columnar lenses respectively take in the radiated lights from the LEDs at the pairs of placement positions of the three LED substrates and output exiting parallel lights that, when viewed in parallel to the central axis, are respectively parallel to the corresponding light emission reference lines or inclined with respect to the corresponding light emission reference lines.

3. The indicating lamp according to claim 2, wherein the six columnar lenses are disposed with gaps provided between each other.

4. The indicating lamp according to claim 3, wherein, when viewed in parallel to the central axis, a circumscribing circle passing through vertices of the equilateral triangle intersects the six columnar lenses.

5. The indicating lamp according to claim 2, comprising: a translucent globe of cylindrical shape that surrounds the three LED substrates and the six columnar lenses and is centered on the central axis; and wherein the globe and the columnar lenses are formed integrally.

6. The indicating lamp according to claim 5, comprising: a translucent globe of cylindrical shape that surrounds the three LED substrates and the six columnar lenses and is centered on the central axis; and wherein the optical system includes a diffusing lens that is provided on the globe and diffuses the exiting lights from the columnar lenses in a circumferential direction of the globe and a light collecting lens that is provided on the globe and suppresses the exiting lights from the columnar lenses from spreading in directions parallel to the central axis.

7. The indicating lamp according to claim 6, wherein the globe includes an inner globe that has an inner circumferential surface on which the diffusing lens is formed and an outer circumferential surface on which a Fresnel lens is formed as the light collecting lens and an outer globe that surrounds the inner globe.

8. The indicating lamp according to claim 6, wherein the globe includes an inner globe that has an outer circumferential surface on which a Fresnel lens is formed as the light collecting lens and an outer globe surrounding the inner globe and having an inner circumferential surface on which the diffusing lens is formed.

9. The indicating lamp according to claim 2, comprising:

a translucent globe of cylindrical shape that surrounds the three LED substrates and the six columnar lenses and is centered on the central axis; and a base member coupled to an opening end of the globe; and wherein the base member includes an LED substrate supporting portion that supports end portions of the LED substrates.

10. The indicating lamp according to claim 9, comprising: a power supply substrate supported by the base member; and wherein three first connectors respectively disposed at the end portions of the three LED substrates and three second connectors disposed at the power supply substrate are coupled as substrate-to-substrate connectors.

11. The indicating lamp according to claim 1, wherein, when viewed in parallel to the central axis, the pair of placement positions on the outer surface of each LED substrate are symmetrical with respect to the reference normal of each LED substrate.

12. The indicating lamp according to claim 1, wherein, when viewed in parallel to the central axis, the pair of light emission reference lines with respect to each LED substrate are symmetrical with respect to the reference normal of each LED substrate.

13. The indicating lamp according to claim 12, wherein, when viewed in parallel to the central axis, the pair of light emission reference lines with respect to each LED substrate are inclined in mutually opposite directions at an inclination angle of 60° with respect to the outer surface of each LED substrate.

14. The indicating lamp according to claim 1, wherein, when viewed in parallel to the central axis, the pair of placement positions on each LED substrate are disposed at outer sides of the pair of light emission reference lines with respect to each LED substrate.

15. The indicating lamp according to claim 1, wherein a plurality of LEDs are aligned in a single column in a direction parallel to the central axis at each of the pair of placement positions of each LED substrate.

16. The indicating lamp according to claim 1, wherein, when viewed in parallel to the central axis, an effective radiation region of each LED includes a central region through which the optical axis of the LED passes, a reference normal side region that is the reference normal side with respect to the central region, and an opposite side region at an opposite side to the reference normal side region, each columnar lens includes a first lens portion that takes in light radiated from the corresponding LED to the reference normal side region and outputs a first exiting parallel light, a second lens portion that takes in light radiated from the corresponding LED to the central region and outputs a second exiting parallel light, and a third lens portion that takes in light radiated from the corresponding LED to the opposite side region and outputs a third exiting parallel light, and the first exiting parallel light, the second exiting parallel light, and the third exiting parallel light are directed in the same direction.

17. The indicating lamp according to claim 16, wherein the first lens portion includes a first incidence surface that takes in without refraction the light radiated to the reference normal side region, an internal reflection surface that is a paraboloid that totally reflects light transmitted through the first incidence surface to make it a first internal parallel light, and a first exit surface that outputs without refraction the first internal parallel light from the internal reflection surface as the first exiting parallel light.

18. The indicating lamp according to claim 16, wherein the second lens portion includes a second incidence surface that refracts and takes in the light radiated to the central region to make it a second internal parallel light and a second exit surface that refracts and outputs the second internal parallel light from the second incidence surface to make it the second exiting parallel light.

19. The indicating lamp according to claim 16, wherein the third lens portion includes a third incidence surface that refracts and takes in the light radiated to the opposite side region to make it a third internal parallel light and a third exit surface that outputs without refraction the third internal parallel light from the third incidence surface as the third exiting parallel light.

20. The indicating lamp according to claim 19, wherein the third incidence surface is a Fresnel surface.

* * * * *